US010794171B2

(12) United States Patent
Rivera-Rios et al.

(10) Patent No.: US 10,794,171 B2
(45) Date of Patent: Oct. 6, 2020

(54) SYSTEMS AND METHODS FOR DRILL BIT AND CUTTER OPTIMIZATION

(71) Applicant: Halliburton Energy Services, Inc., Houston, TX (US)

(72) Inventors: Aixa Maria Rivera-Rios, Houston, TX (US); Burkay Donderici, Houston, TX (US); Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 137 days.

(21) Appl. No.: 15/779,822

(22) PCT Filed: Mar. 23, 2016

(86) PCT No.: PCT/US2016/023806
§ 371 (c)(1),
(2) Date: May 29, 2018

(87) PCT Pub. No.: WO2017/164867
PCT Pub. Date: Sep. 28, 2017

(65) Prior Publication Data

US 2018/0340410 A1 Nov. 29, 2018

(51) Int. Cl.
*E21B 44/02* (2006.01)
*E21B 10/00* (2006.01)
(Continued)

(52) U.S. Cl.
CPC ..... *E21B 44/02* (2013.01); *E21B 10/00* (2013.01); *E21B 44/00* (2013.01); *E21B 47/06* (2013.01);
(Continued)

(58) Field of Classification Search
CPC ..... E21B 10/00; E21B 44/00; E21B 44/02; E21B 47/06; E21B 49/003
See application file for complete search history.

(56) References Cited

U.S. PATENT DOCUMENTS 8,695,729 B2 4/2014 Kumar et al.
9,695,642 B2 7/2017 Hay
(Continued)

FOREIGN PATENT DOCUMENTS

CA 2745723 C 2/2014
EP 2836677 A1 11/2017
(Continued)

OTHER PUBLICATIONS

International Search Report and Written Opinion dated Dec. 23, 2016; International PCT Application No. PCT/US2016/023806.

*Primary Examiner* — D. Andrews
(74) *Attorney, Agent, or Firm* — McGuireWoods LLP

(57) ABSTRACT

A drill bit analysis and optimization system for use in a wellbore is provided. The system includes a drill bit including a cutter, a sensor that collects a data signal on a surface of the drill bit proximate to the cutter, and a signal processor unit that receives the data signal from the sensor and receives the expected drilling properties from the data reservoir. The processor analyzes the data signal to detect a resistivity profile from the sensor through a formation and optimizes a drilling parameter by comparing actual drilling properties with expected drilling properties.

15 Claims, 16 Drawing Sheets

(51) Int. Cl.

| | |
|---|---|
| ***E21B 44/00*** | (2006.01) |
| ***E21B 47/06*** | (2012.01) |
| ***E21B 49/00*** | (2006.01) |
| *E21B 47/13* | (2012.01) |
| *E21B 47/20* | (2012.01) |
| *E21B 47/26* | (2012.01) |
| *E21B 47/16* | (2006.01) |

(52) U.S. Cl.
CPC ..... *E21B 49/003* (2013.01); *E21B 47/13* (2020.05); *E21B 47/16* (2013.01); *E21B 47/20* (2020.05); *E21B 47/26* (2020.05)

(56) References Cited

U.S. PATENT DOCUMENTS

| | | | | |
|---|---|---|---|---|
| 2012/0312599 | A1* | 12/2012 | Trinh ..... | E21B 47/00 175/57 |
| 2013/0020130 | A1 | 1/2013 | Trinh et al. | |
| 2014/0095134 | A1 | 4/2014 | Cariveau et al. | |
| 2015/0129306 | A1 | 5/2015 | Coffman et al. | |
| 2016/0076355 | A1 | 3/2016 | Scott et al. | |
| 2017/0342815 | A1 | 11/2017 | Hay | |

FOREIGN PATENT DOCUMENTS

| | | | |
|---|---|---|---|
| WO | 2010054353 | A2 | 5/2010 |
| WO | 2013043555 | A1 | 3/2013 |

* cited by examiner

SYSTEMS AND METHODS FOR DRILL BIT AND CUTTER OPTIMIZATION

BACKGROUND

1. Field

This invention relates to logging while drilling (LWD) systems and methods. More specifically, the invention relates to adjusting drilling parameters in real-time and obtaining a cutter or bit design for future drilling applications using systems and methods for drill bit optimization using sensors placed on the drill bit.

2. Description of the Related Art

In drilling applications, it is beneficial to obtain a drill bit suited for each type subsurface formation. Additionally, during drilling under high pressure and high temperature conditions, the overall drill bit, as well as sub-components of the drill bit including bit cutters, can undergo damage from heat, impact with formation, or abrasion.

Figure 1:
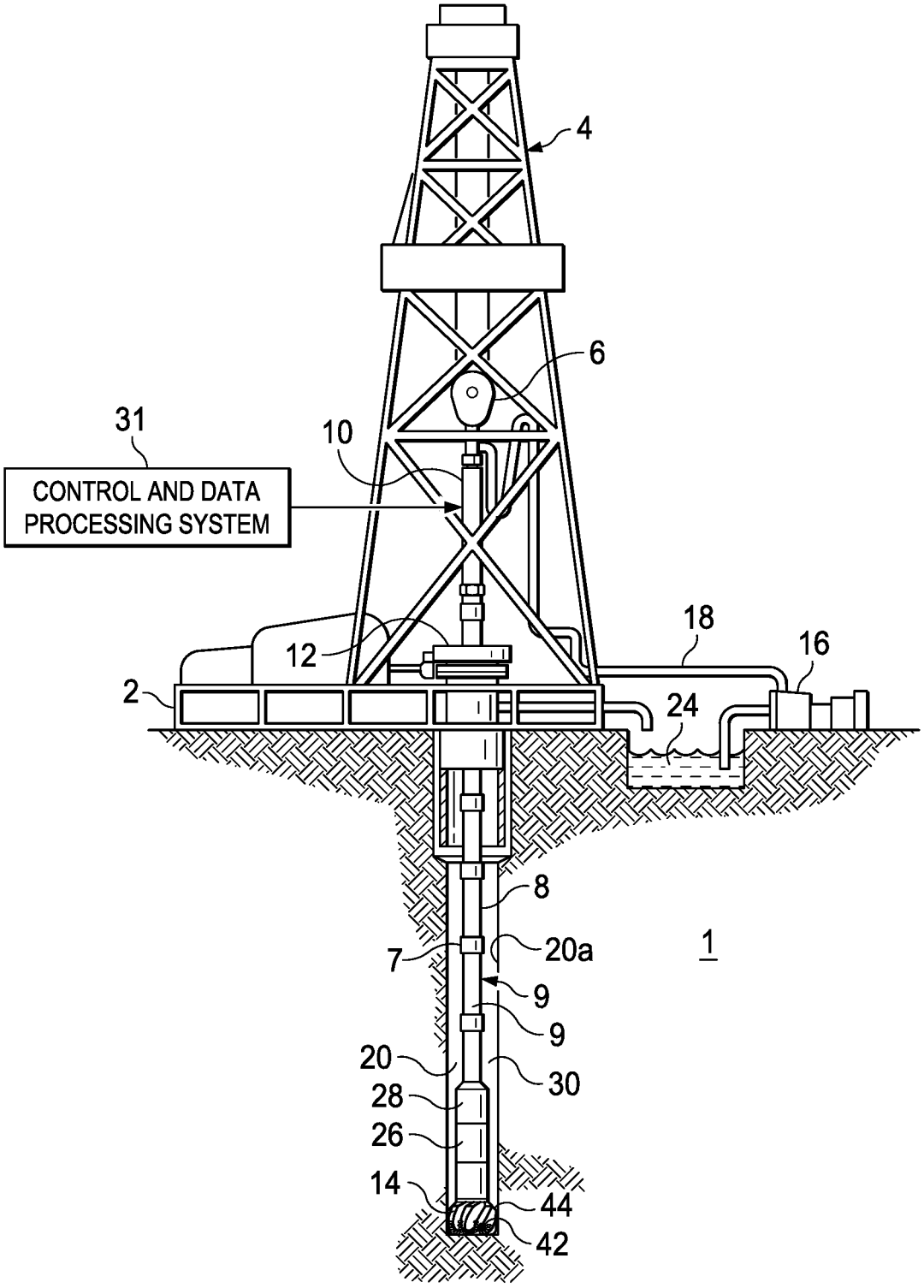
FIG. 1 is an illustrative environment in which such a drill bit analysis and optimization system may be employed according to one or more embodiments of the present disclosure.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

In the following detailed description of the illustrative embodiments reference is made to the accompanying drawings that form a part thereof and is provided to assist the reader in gaining a comprehensive understanding of the methods, apparatuses, and/or systems described herein. These embodiments are described in sufficient detail to enable those skilled in the art to practice the invention, and it is understood that other embodiments may be utilized and that logical structural, mechanical, electrical, and chemical changes may be made without departing from the spirit or scope of the invention. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order.

To avoid detail not necessary to enable those skilled in the art to practice the embodiments described herein, the description may omit certain information known to those skilled in the art. Also, the respective descriptions of well-known functions and constructions may be omitted for increased clarity and conciseness. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion and thus should be interpreted to mean "including, but not limited to." Unless otherwise indicated, as used throughout this document, "or" does not require mutual exclusivity.

The following description describes resistivity analysis and distance measurement between sensors on a drill bit and a formation to specifically obtain information about the performance of a cutter on the drill bit that is within close proximity of the sensors. With the resistivity and distance measurements provided by placing sensors between the cutters on the drill bit, performance analysis of each cutter on a drill bit may be performed. Two dimensional (2D) analysis of each cutter and corresponding formation cut can be implemented by placing sensors on all four sides of the cutter. The 2D analysis can be obtained by a process that can provide a visualization that is related to the depth of cut and resistivity of a formation.

The following description further relates to various embodiments of the design and use of a drill bit analysis and optimization system having a sensor for the resistivity analysis and distance measurements. FIG. 1 shows an illustrative environment in which such a drill bit analysis and optimization system may be employed to acquire information regarding cutters that make up a surface of a drill bit 14 and earth formation 1. The acquired information may relate specifically to a particular cutter 44 on the drill bit 14 in proximity of sensors 42 and the cut in the earth formation 1 created by the cutter 44.

FIG. 1 shows a drilling platform 2 equipped with a derrick 4 that supports a hoist 6. Drilling of a borehole, for example, the borehole 20, is carried out by a string of drill pipes 8 connected together by "tool" joints 7 so as to form a drill string 9. The hoist 6 suspends a kelly 10 that is used to lower the drill string 9 through rotary table 12. Connected to a lower end of the drill string 9 is a drill bit 14. The drill bit 14 is rotated, and the drilling of the borehole 20 is accomplished by rotating the drill string 9, by use of a downhole motor (not shown) located near the drill bit 14 or by a combination of the two. Drilling fluid, sometimes referred to as "mud", is pumped, by mud recirculation equipment 16, through supply pipe 18, through drilling kelly 10 and down through interior throughbore of the drill string 9. The mud exits the drill string 9 through apertures, sometimes to referred to as nozzles as shown in FIGS. 2A-5B, in the drill bit 14. The mud then travels back up through the borehole 20 via an annulus 30 formed between an exterior side surface 9*a* of the drill string 9 and a wall 20*a* of the borehole 20, through a blowout preventer and a rotating control device (not shown), and into a mud pit 24 located on the surface. On the surface, the drilling mud is cleaned and then returned into the borehole 20 by the mud recirculation equipment 16 where it is reused. The drilling fluid is used to cool the drill bit 14, to carry cuttings from the base of the borehole 20 to the surface, and to balance the hydrostatic pressure in the subsurface earth formation 1 being explored. The drill bit 14 is part of a bottom-hole assembly ("BHA") that may include one or more LWD tools 26 and a downhole controller/telemetry transmitter 28.

Broadly speaking, each of the one or more downhole sensors 42 acquires information regarding the subsurface earth formation 1 and the cutter 44 of the drill bit 14 that is within a certain proximity of the downhole sensors 42. While it is fully contemplated that the one or more downhole sensors 42 may include any number of different types of sensors or other devices designed to acquire different types of information regarding the subsurface earth formation 1, one such downhole sensor would be an electromagnetic (EM) sensor, also identified herein by reference numeral 42. The sensor 42, which will be more fully described below, can alternatively be any one of a family of sensors.

As the sensor 42 acquires information regarding surrounding formations, the information may be processed and stored by the downhole controller/telemetry transmitter 28. Alternatively, or in addition, the information may be transmitted by the downhole controller/telemetry transmitter 28 to a telemetry receiver (not shown) at the surface. Downhole controller/telemetry transmitter 28 may employ any of various telemetry transmission techniques to communicate with the surface, including modulating the mud flow in the drill string 9, inducing acoustic vibrations in the drill string walls, transmitting low-frequency electromagnetic waves, using a wireline transmission path, and storing the collected data signal for retrieval when the drill string 9 is removed from the borehole 20. The telemetry receiver detects the transmitted signals and passes them to a control and drilling data processing system 31 which, for ease of description, is shown in FIG. 1 as being schematically coupled to the drilling kelly 10. The control and drilling data processing system 31 may record and/or process the received data signals to derive information regarding the subsurface earth formation 1 and cutter 44 on the drill bit 14. In other embodiments, the control and data processing system 31, which contains a processor, may be located anywhere along the drill string 9 including, but not limited to, at the drill bit 14, in the LWD tool 26, in the controller/telemetry transmitter 28, at the surface above the rotary table 12 as shown, off-site, or some combination thereof.

In some embodiments, the control and drilling data processing system 31 may be further configured to issue commands to the drill bit 14 to alter the operating parameters, also called drilling parameters, of the drill bit 14. Drilling parameters are variables that control the drilling and design of the cutters and drill bit. The drilling parameters may include temperature, drill bit placement, revolutions per minute (RPM), fluid pressure, pore pressure, weight on bit (WOB), a recommended repair or replacement of a cutter, drill bit, or motor, a change to a drill bit design, or a change to a cutter design. Further, certain of these drilling parameters may be adjusted substantially simultaneously with the time of collection of data with a delay of only the time taken to transmit, process, and return the adjusted drilling parameters. This new simultaneous control from data signal collection to drilling parameter adjust can be said to occur in "real-time." Said another way, "real-time" is when input data, in this case a collected data signal, is processed within, for example, seconds so that it is available virtually immediately as feedback, which in this case is used to adjust drilling parameter. Alternatively, the system 31 may be further configured to select and implement a design drilling parameter. This may be done by updating the design of one or more cutters on the drill bit or some other design feature of the drill bit, manufacturing the updated drill bit, then replacing the drill bit 14 with the updated drill bit.

Figure 2A:
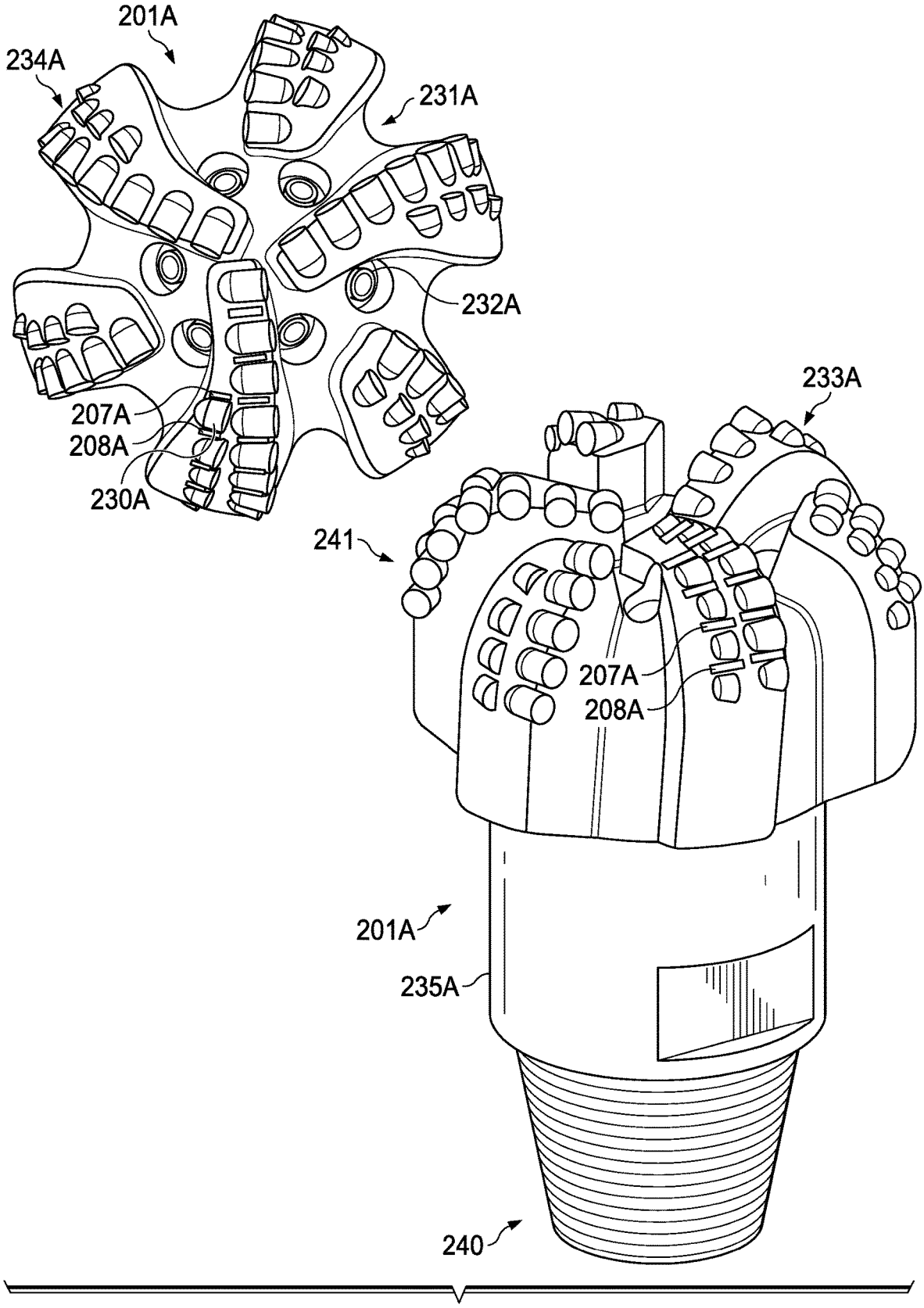
FIG. 2A shows a perspective view and top view of a fixed cutter drill bit with sensors placed along the sides of cutters according to one or more embodiments of the present disclosure.

According to an embodiment as shown in FIG. 2A, a fixed cutter drill bit 201A may be provided with sensors 207A, 208A. As shown, the fixed cutter drill bit 201A includes a bit body 235A which may have an externally threaded connection (not shown) at a first end 240, and a plurality of blades 233A extending from a second end 241 of the bit body 235A. The blades 233A extend from a top portion of the second end 241 along a longitudinal axis of the drill bit 201A with grooves 231A forming between the blades 233A. The drill bit 201A also has nozzles 232A that form at the top portion of the second end 241 within the grooves 231A. A plurality of cutters 234A is attached to each of the blades 233A and extends from the blades 233A to cut through an earth formation, such as earth formation 1, when the drill bit 201A is rotated during drilling. The plurality of cutters 234A deforms the earth formation by scraping and shearing. In one embodiment, the plurality of cutters 234A are tungsten carbide inserts. Alternatively, the plurality of cutters 234A may be polycrystalline diamond compacts, milled steel teeth, or any other cutting elements of materials hard and strong enough to deform or cut through the formation.

The sensors 207A, 208A are located on the surface of the drill bit 201A proximate to the cutter 230A performing measurements along an axis that is perpendicular to a direction of bit rotation, wherein the cutter 230A is disposed between the sensors 207A, 208A. In one embodiment, the sensors 207A, 208A are magnetic coils that function as electromagnetic sensors. Alternatively, the sensors 207A, 208A may be electrode sensors, other electromagnetic sensors, other sensors suitable or measuring resistivity or a combination of the foregoing depending on the drilling application and desired drilling properties that are to be collected and analyzed. Other factors may also be taken into consideration when selecting sensor type. For example, the selection of a sensor 207A or 208A may depend on how conductive the borehole mud is with respect to the formation conductivity. Magnetic coil sensors may optimally operate in oil based muds, while electrode sensors may optimally operate in water based muds. As shown, multiple sensors may be included on the drill bit 201A proximate to other of the sides of some of the plurality of cutters 234A. In other embodiments, sensors may be included proximate to all of the plurality of cutters 234A, every other cutter, or other select cutters of the plurality of cutters 234A, or on either side of only the one cutter 230A. One or more example configurations include but are not limited to one sensor pair per cutter blade, one sensor pair at each end of a cutter blade, and/or a sensor pair at the cutter having first or most frequent contact with the formation. Magnetic coils and electrodes may be placed in grooves that are machined on the surface of the bit. Electrical connections to the coils or electrodes may be provided through holes that are drilling in the bit, or through grooves that are designed to support the wiring. Placement of the coils or electrodes may be made in recessed areas of the bit in such a way that erosion due to drilling on the coil or electrode structure is minimized. Electrodes and coil wires may be insulated from the bit surface using any non-conductive material.

Figure 2B:
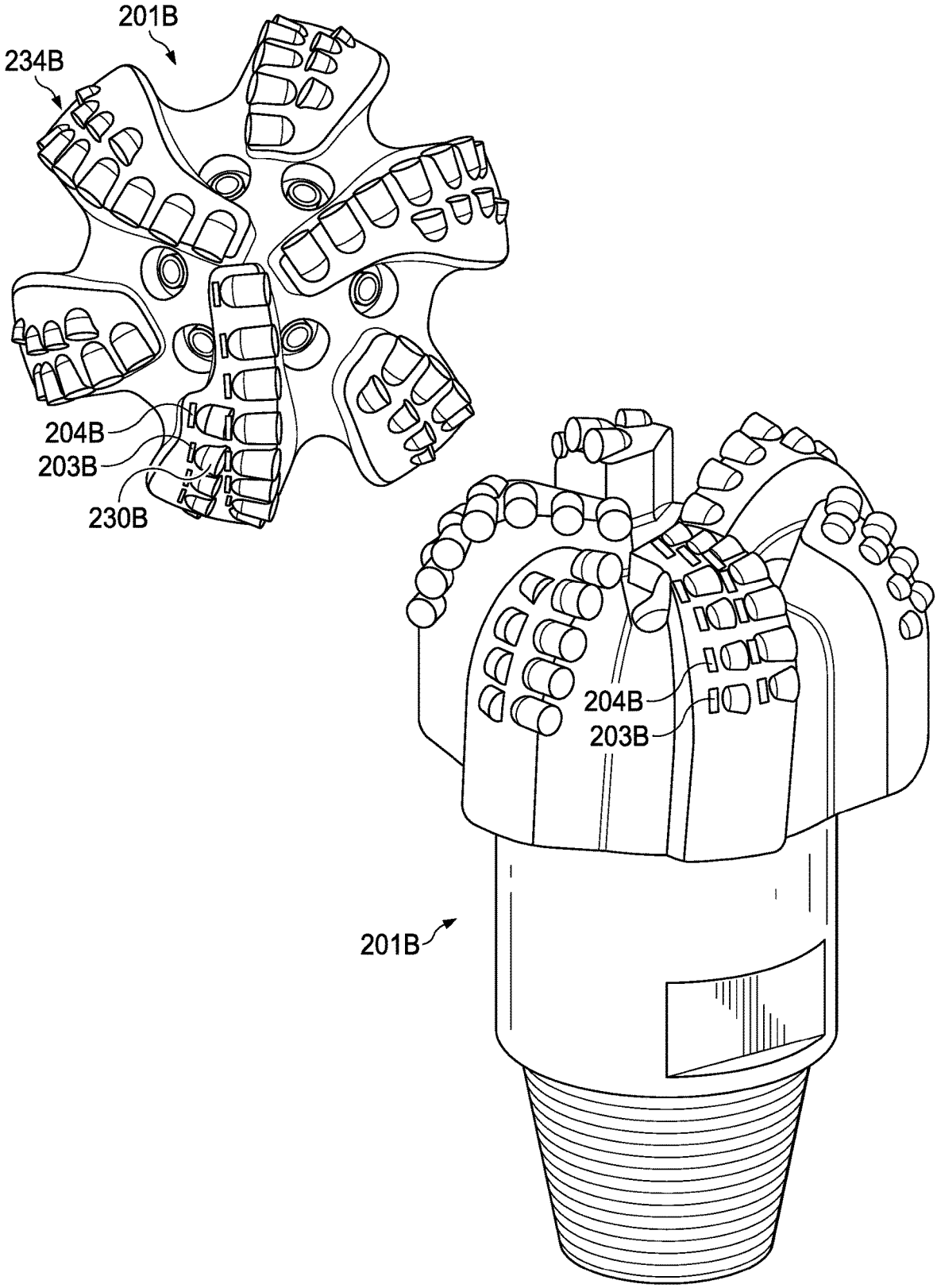
FIG. 2B is a perspective view and top view of a fixed cutter drill bit with sensors placed in front of cutters according to one or more embodiments of the present disclosure.

According to another embodiment, as shown in FIG. 2B, a fixed cutter drill bit 201B is provided that is similar to the drill bit 201A including similar cutters 230B and plurality of cutters 234B. A front side of a cutter is the side of the cutter that faces in the direction of bit rotation and, in some embodiments, is the side that has a blade edge for cutting into a formation. In contrast to drill bit 201A, the drill bit 201B may include sensors 203B, 204B that are placed proximate to the front side of some cutters 230B of a plurality of cutters 234B along the direction of bit rotation. In this case, the sensors 203B, 204B will measure a cut of the formation in the direction of drilling rotation. The number and position of cutters and sensors may vary based on formation type. For example, according to another embodiment, a combination of sensors 207A, 208A and sensors 203B, 204B may be provided around the cutters 230B, the plurality of cutter 234B, or a single cutter such that the sensors 207A, 208A, 203B, 204B surround the cutter.

Figure 2C:
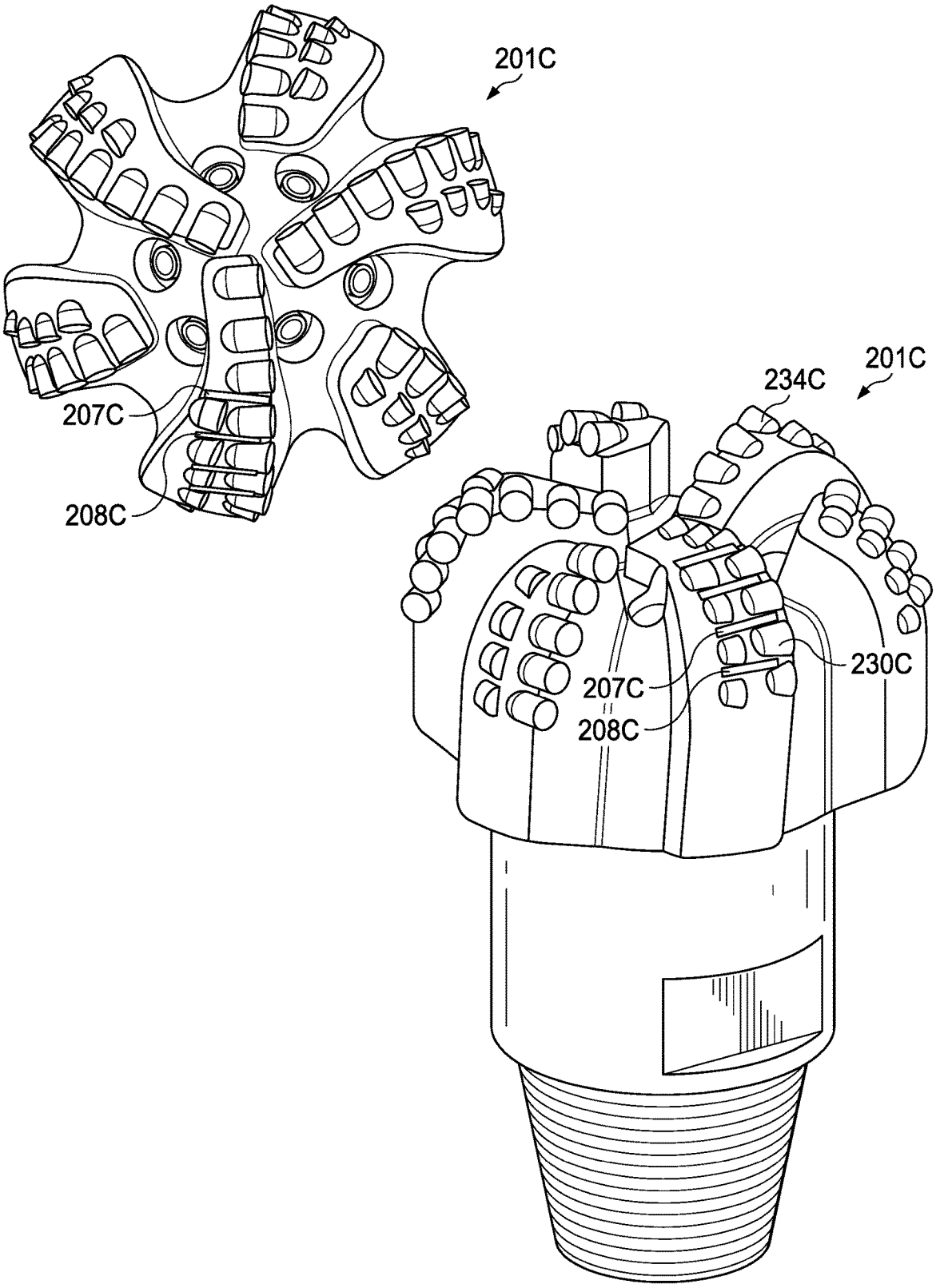
FIG. 2C is a perspective view and top view of a fixed cutter drill bit with sensors placed along the sides of cutters according to one or more embodiments of the present disclosure.
Figure 2D:
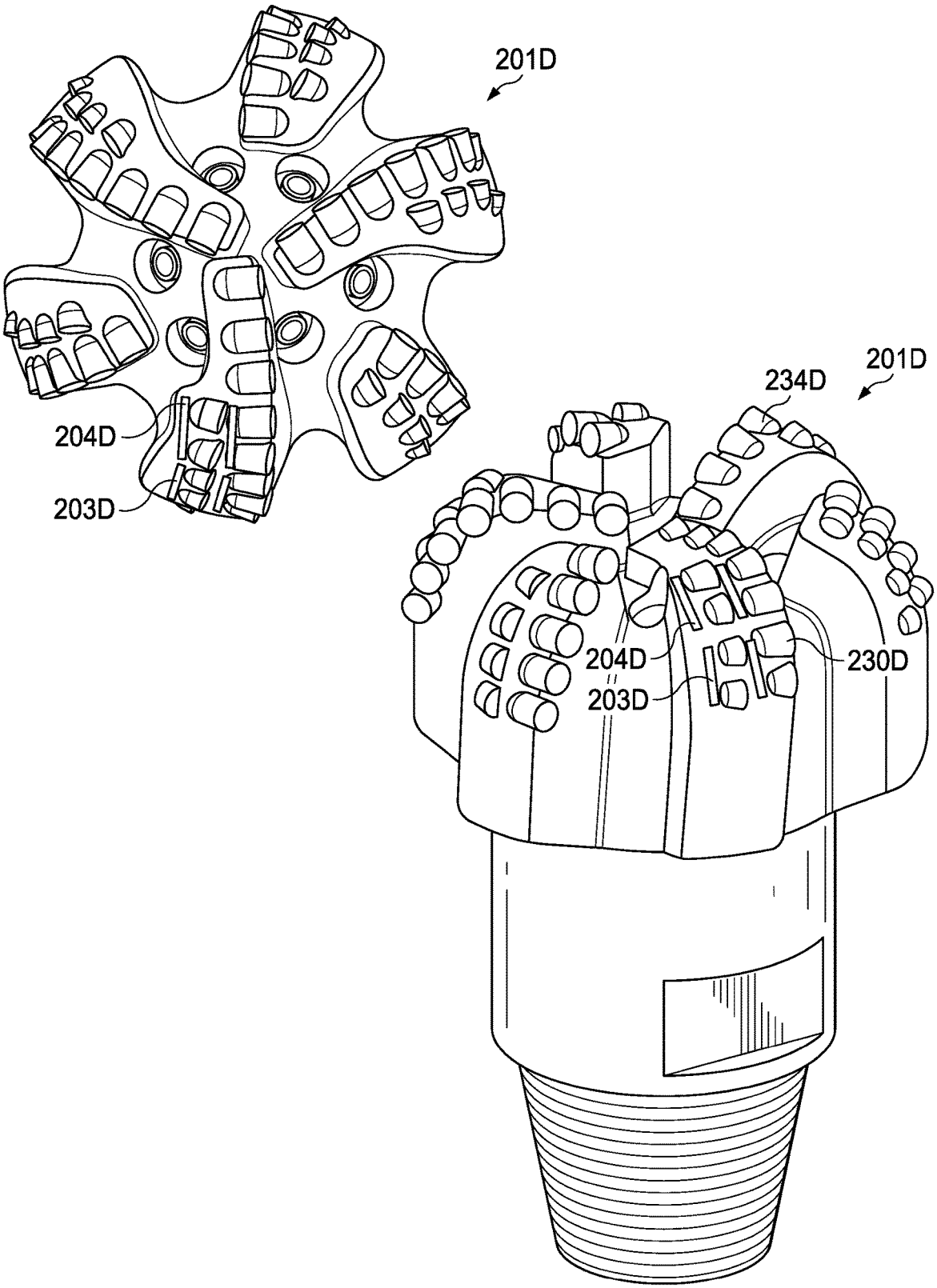
FIG. 2D is a perspective view and top view of a fixed cutter drill bit with sensors placed in front of and behind cutters according to one or more embodiments of the present disclosure.

In another embodiment, as shown in FIG. 2C, a fixed cutter drill bit 201C is provided that is similar to the drill bit 201A. The drill bit 201C is different from drill bit 201A in that the drill bit 201C is provided with sensors with different dimensions and placement from those of drill bit 201A. Specifically, drill bit 201C includes elongated sensors 207C, 208C that each extend along the sides of multiple cutters 230C of a plurality of cutter 234C. In another embodiment, as shown in FIG. 2D, a fixed cutter drill bit 201D is provided that is similar to the drill bit 201A. The drill bit 201D is different from drill bit 201A in that drill bit 201D includes elongated sensors 203D, 204D that extend proximate the front side of multiple cutters 230D of a plurality of cutters 234D. According to another embodiment, a combination of elongated sensors 207C, 208C and elongated sensors 203D, 204D may be provided around the cutters 230D or the plurality of cutter 234D such that the elongated sensors 207A, 208A, 203B, 204B surround the cutters. In other embodiments, the number and position of cutters, sensors, and elongated sensors may vary based on formation type.

Figure 3:
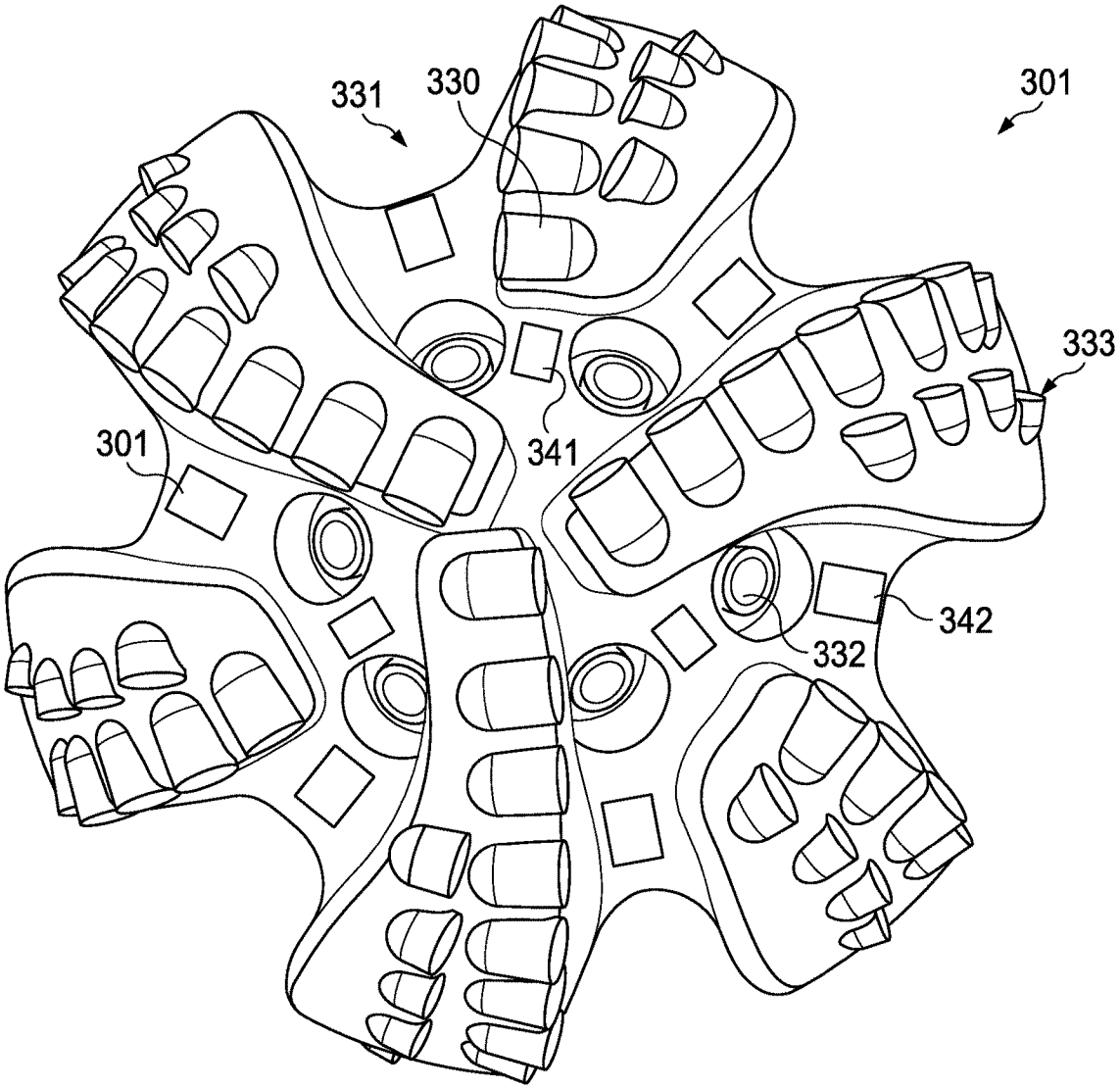
FIG. 3 is a top view of a fixed cutter drill bit with sensors placed at locations within grooves of the drill bit away from cutter blades according to one or more embodiments of the present disclosure.

In another embodiment, as shown in FIG. 3, a fixed cutter drill bit 301 is provided that is similar to the drill bit 201A from FIG. 2A. The drill bit 301 is different from drill bit 201A in that drill bit 301 includes sensors 341, 342 that are placed at locations within grooves 331 of the drill bit 301 near the nozzles 332 away from the blades 333 on which the cutters 330 are located. As shown, sensor 342 is placed next to a nozzle 332 along the longitudinal axis of the drill bit 301 such that the sensor 342 is located proximate the front side of the cutters 330 in a direction of bit rotation. Sensor 341 is placed in between two of the nozzles 332 such that the sensor 341 is next to some of the cutters 330. Thus, sensors 341, 342 can be used in a similar manner to those shown in FIG. 2A through FIG. 3. Additionally, these sensors 341, 342 can be used to analyze the mud injected via nozzles 332, such as analyzing the mud injection rate or resistivity of mud.

Figure 4:
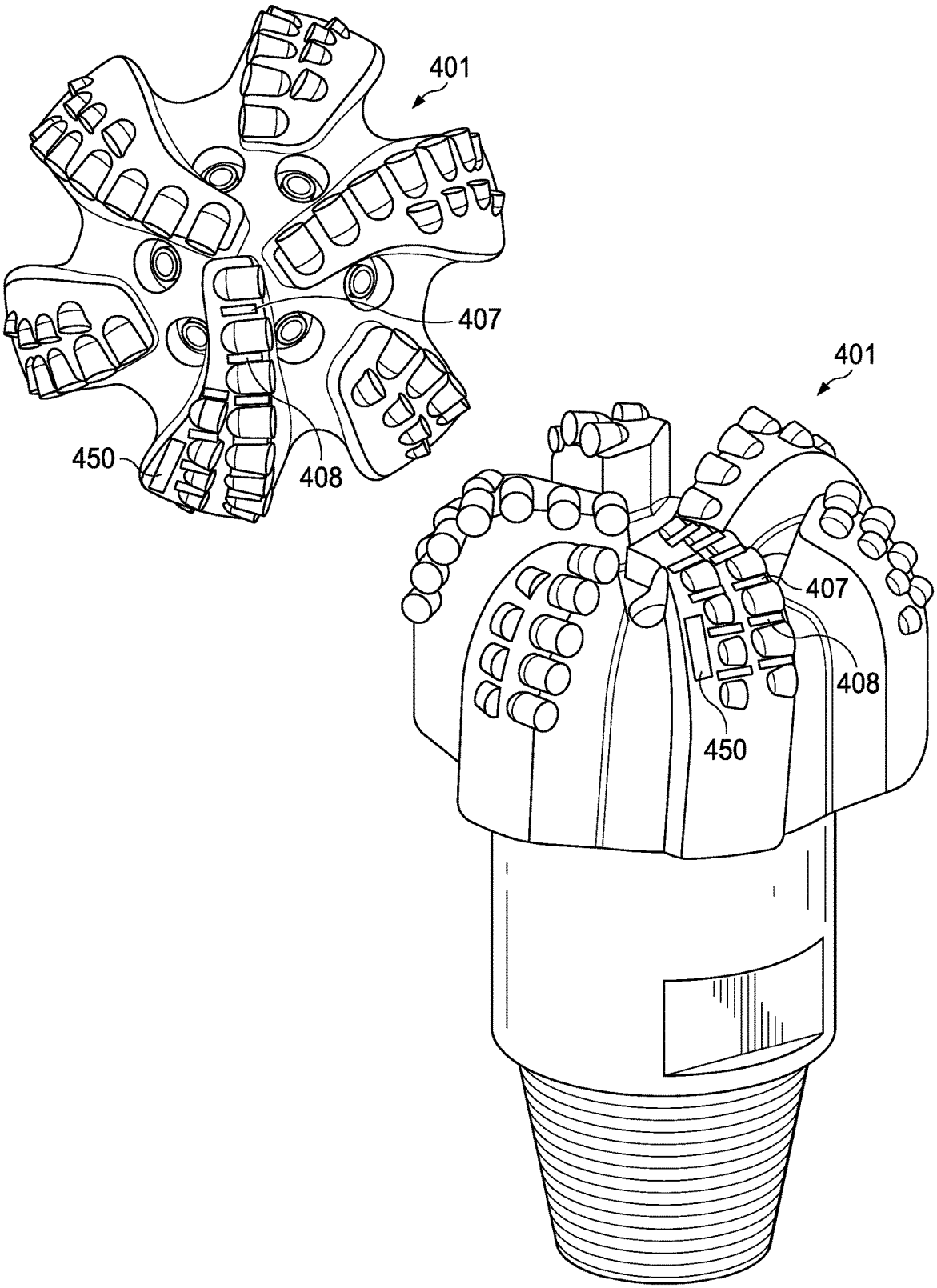
FIG. 4 is a top view and a perspective view of a drill bit with sensors and a source/transmitter according to one or more embodiments of the present disclosure.

FIG. 4 shows a drill bit 401 that is similar to drill bit 201A from FIG. 2A. However, drill bit 401 is different from drill bit 201A in that drill bit 401 it includes a transmitter 450 as a signal source which transmits a data signal to be detected by a sensor and is separate from sensors 407, 408. The sensors 407, 408 serve as receivers for the data signal that is transmitted by the transmitter 450. As shown, the transmitter 450 is placed along the direction of bit rotation proximate a distal end of the cutters, and the sensors 407, 408 are placed proximate the cutters along an axis of the cutter that is perpendicular to the direction of bit rotation. In another embodiment the transmitter 450 may be placed along the direction of bit rotation near a proximal end of the cutters such that the transmitter 450 is disposed on the surface proximate the front side of the cutters. Alternatively, according to another embodiment, the transmitter 450 and the sensors 407, 408 locations may be switched. In yet another embodiment, if another LWD tool is used in the drill string that emits a data signal detectable by the sensors 407, 408, the data signal emitted by the LWD tool may be received and treated as the signal source by the sensors 407, 408.

In one embodiment, transmitter 450 is a dipole and sensors 341 and 342 are electrode sensors. In such an embodiment, the dipole transmitter injects current into the formation and the electrode sensors detect the current. In another embodiment, transmitter 450 is a magnetic coil and sensors 341 and 342 are also magnetic coils. In such an embodiment the transmitter 450 magnetic coil produces a magnetic field that propagates into the formation that is detected by the sensors 341 and 342. In one embodiment, the signal source is at the same position as the sensor configured to receive that signal source. For example, as shown in FIG. 2A through 3, the sensors are transceivers which both inject either a current or a magnetic field and also measure secondary fields that are disturbed by the formation. According to another embodiment, a combination of one or more of the different sensor placements and shapes from FIG. 2A through FIG. 4 may be provided on a drill bit.

Figure 5A:
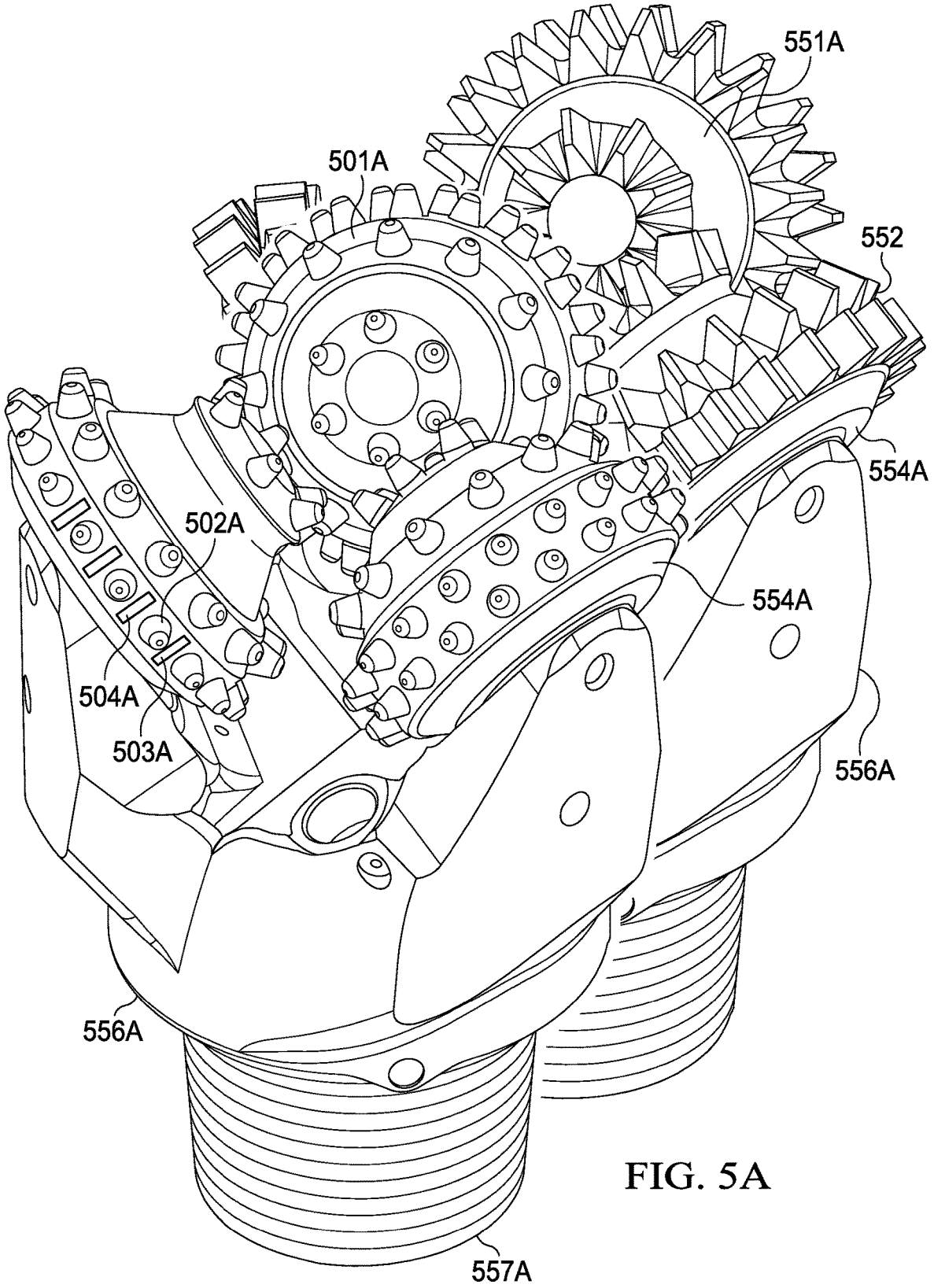
FIG. 5A is a perspective view of two roller cone drill bits with sensors according to one or more embodiments of the present disclosure.
Figure 5B:
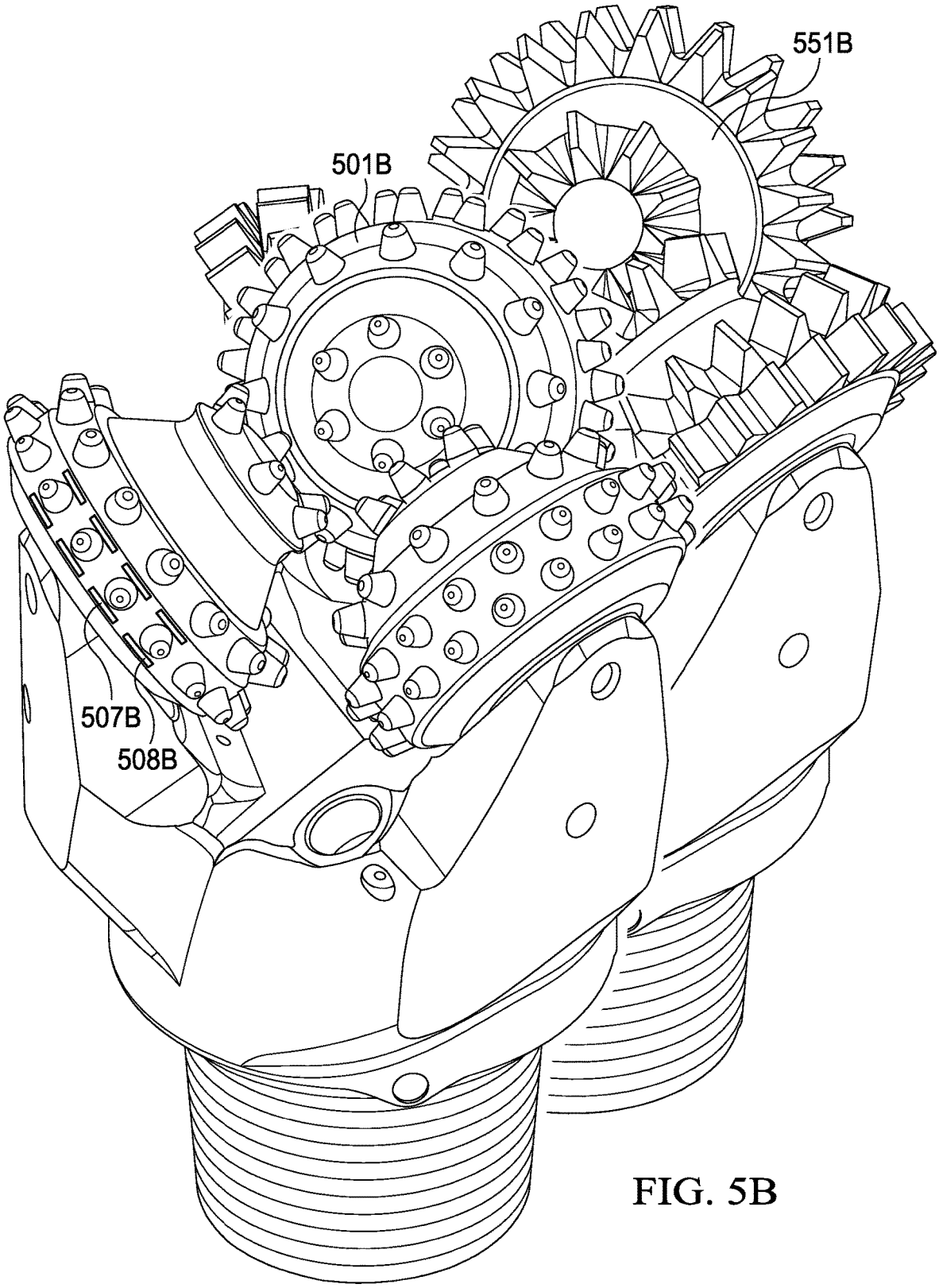
FIG. 5B is a perspective view of two roller cone drill bits with sensors according to one or more embodiments of the present disclosure.

In other embodiments, sensors similar to those shown in FIG. 2A through FIG. 4 may be included in different types of drill bits. For example, as shown in FIGS. 5A and 5B, two types of roller cone drill bits are shown that include sensors in close proximity to their respective cutters. The two types of roller cone drill bits each have a different type of cutter disposed on the surface of the drill bits.

Specifically, as shown in FIG. 5A a roller-cone drill bit 501A is provided. The roller-cone drill bit 501A includes a base housing 556A that has a threaded connection portion 557A at one end and three roller cones 554A arranged at the other end. The roller cones 554A each include a plurality of cutters 502A. The cutters 502A are of a particular button shape. Accordingly the plurality of cutters 502A may more specifically be called a plurality of buttons 502A. Additionally, the roller-cone drill bit 501A includes sensors 503A, 504A that are located along an axis in a direction of roller cone rotation between one or more of the plurality of buttons 502A provided on one of the three roller cones 554A. FIG. 5B shows a roller-cone drill bit 501B that is similar to drill bit 501A except that the roller-cone drill bit 501B includes sensors 507B, 508B that are placed along an axis that is perpendicular to the direction of roller cone rotation with one or more of the plurality of buttons disposed between the sensors 507B, 508B on a roller cone of the drill bit 501B. According to other embodiments, a combination of one or more sensors 503A, 504A, 507B, 508B may be included that are placed in close proximity to the plurality of buttons 502A in a similar fashion as described about with regard to FIGS. 2A through 4. In another embodiment, as shown in FIGS. 5A and 5B, a roller-cone drill bit 551A, 551B includes a plurality of cutters 552 where each cutter is in the shape of a pointed tooth. Thus the plurality of cutters 552 may be more specifically called a plurality of teeth 552. Sensors 503A, 504A, 507B, 508B may be included in close proximity to the plurality of teeth 552 in similar arrangements as discussed above for drill bits 501A and 501B. According to other embodiments, sensors may be included in close proximity to cutters on drill bits with other shapes and designs.

Figure 6:
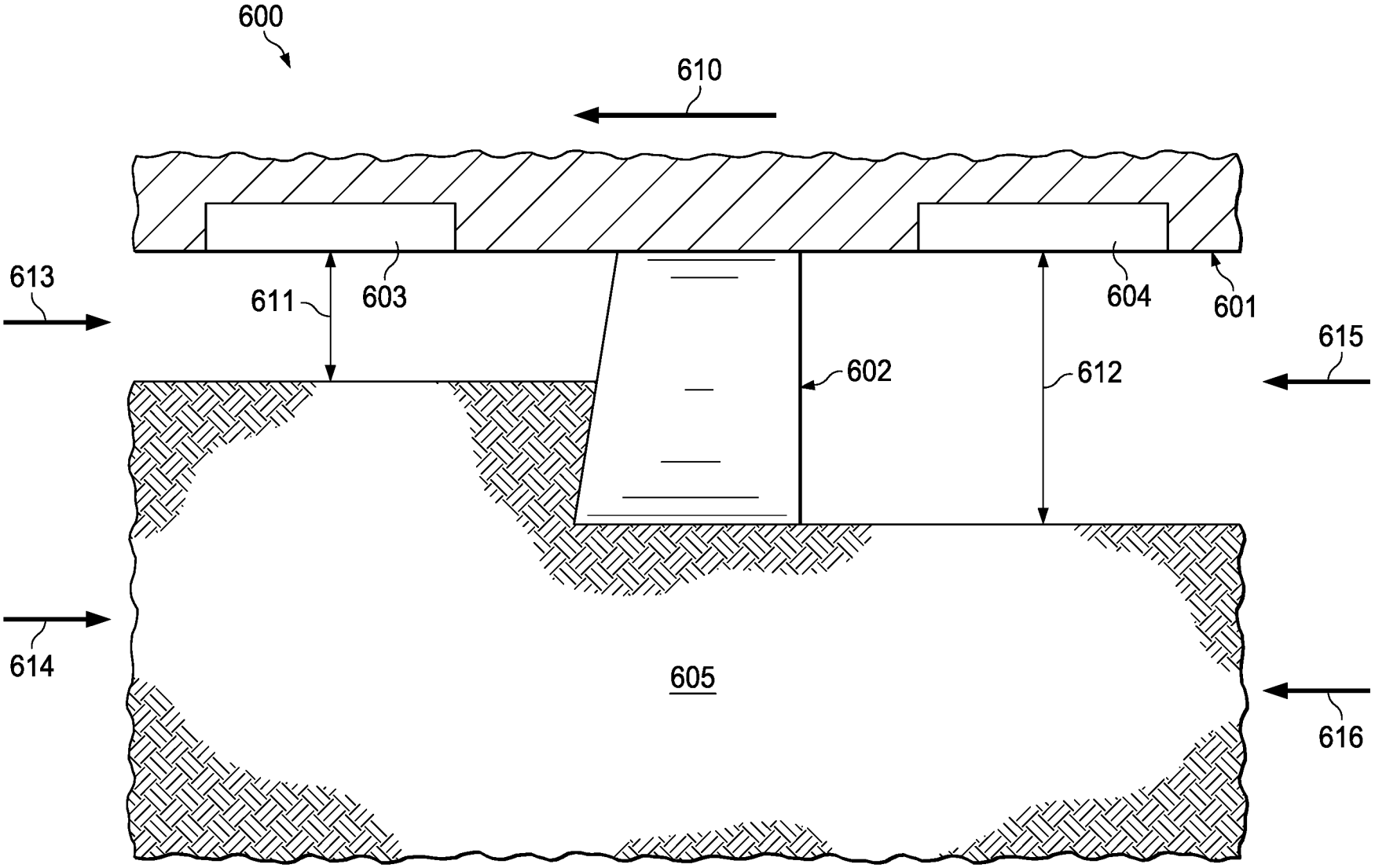
FIG. 6 is a cross sectional view along a direction of bit rotation of a single cutter on a drill bit with sensors according to one or more embodiments of the present disclosure.

FIG. 6 illustrates a cross-sectional view of an embodiment drill bit analysis and optimization system 600 for use in a borehole. The analysis and optimization system 600 includes at least a single cutter 602 on a drill bit 601 provided with sensors 603, 604 placed in front and behind the cutter 602 along a direction of bit rotation 610. Specifically, a front sensor 603 is provided along a surface of the drill bit 601 at a front location directly in front of the cutter 602 along the direction of bit rotation 610. A back sensor 604 is provided along the surface of the drill bit 601 at a back location directly behind the cutter 602 along the direction of bit rotation 610. A formation 605 is shown that is impacted by the cutter 602 as drill bit 601 rotates. A front resistivity 613 is detected from an area extending from the front sensor 603 to the formation 605. A front formation resistivity 614 is detected from an area within the formation 605 below the area from which the front resistivity 613 is detected. The front resistivity 613 and the front formation resistivity 614 may be included together in a front resistivity profile. The front resistivity profile may include additional resistivity values as well. A back resistivity 615 is detected from an area extending from the back sensor 604 to the formation 605. A back formation resistivity 616 is detected from an area within the formation 605 below the area from which the back resistivity 615 is detected. The back resistivity 615 and the back formation resistivity 616 may be included together in a back resistivity profile. The back resistivity profile may include additional resistivity values as well. A front distance 611 is defined by the distance between the front sensor 603 and the formation 605. A back distance 612 is defined by the distance between the back sensor 604 and the formation 605. The front distance 611 is calculated using the front resistivity profile and the back distance 612 is calculated using the back resistivity profile. As shown, the front distance 611 is smaller than the back distance 612 as the cutter 602 moves along the direction of bit rotation 610 cutting into and breaking apart portions of the formation 605. Once the above note values are collected and calculated, operations can be executed that provide specifics about the properties of the drill bit and the cutter as well as the formation. For example, the depth of cut, the shape and condition of the drill bit, the shape and condition of the cutter, the density of the formation, the density of the space between the formation and the drill bit, the rate of penetration, the shape of the borehole in the formation, as well as other properties can be determined through analysis of the collected values.

Figure 7:
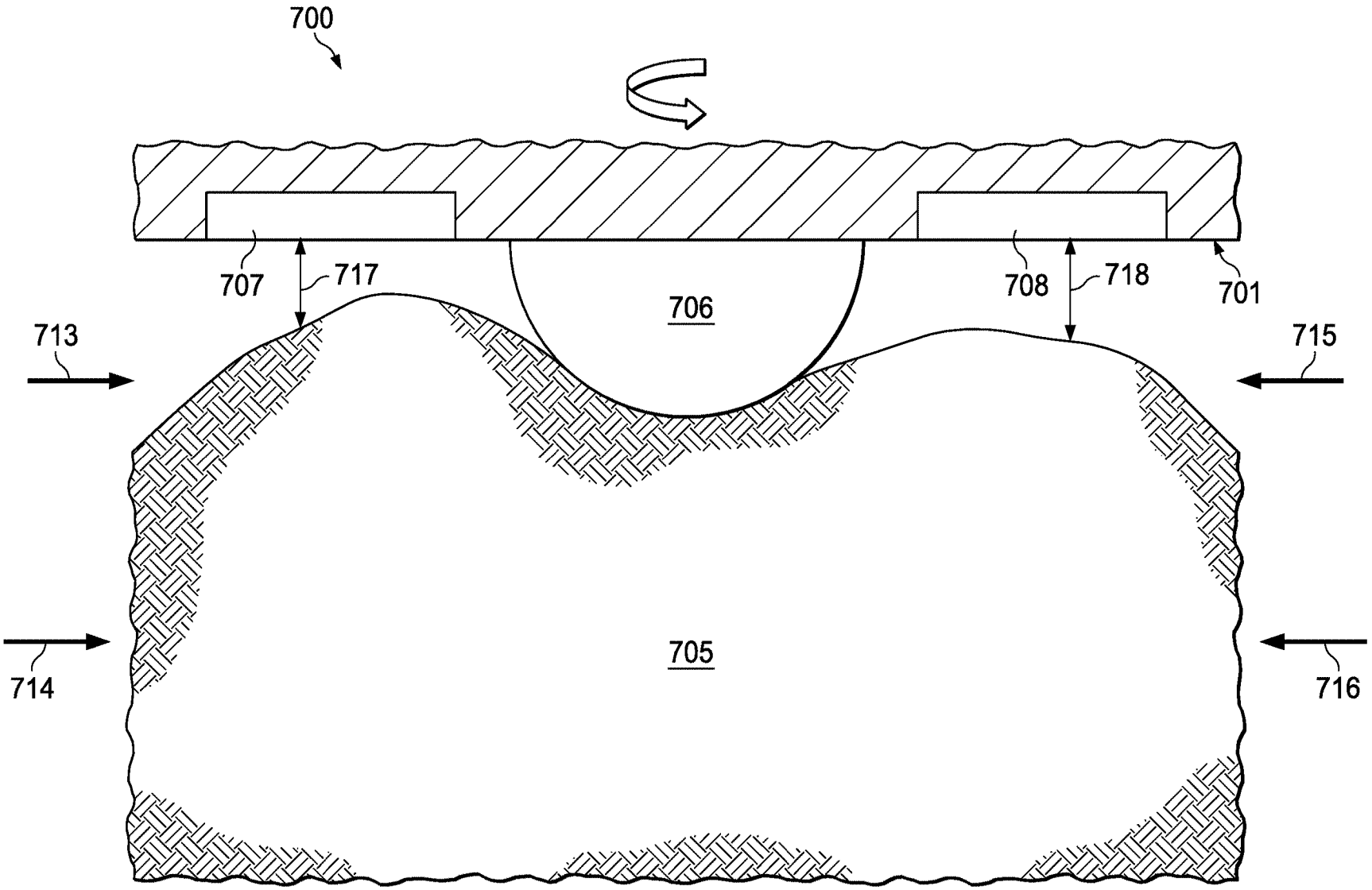
FIG. 7 is a cross sectional view taken perpendicular to a direction of bit rotation of a single cutter on a drill bit with sensors according to one or more embodiments of the present disclosure.

According to another exemplary embodiment, as shown in FIG. 7, a drill bit analysis and optimization system 700 for use in a borehole is provided. The drill bit analysis and optimization system 700 includes a drill bit 701 with a cutter 706 provided on a surface of the drill bit 701. The cutter 706 has a curved shape when viewed in this cross-sectional view taken along an axis that is perpendicular to the direction of rotation of the drill bit 610. The drill bit includes sensors 707, 708 located on the surface of the drill bit 701 proximate to the cutter 706 along the axis that is perpendicular to the direction of bit rotation 610 (shown in FIG. 6), wherein the cutter 706 is disposed between the sensors 707, 708. Side distances 717, 718 that respectively correspond to distances between sensors 707, 708 and the formation 705 are also provided. Further, side resistivity values 713, 715 are detected from areas between the sensors 707, 708 and the formation 705, respectively. Further side formation resistivity values 714, 716 are detected from areas within the formation 705 below each corresponding sensor 707, 708. Formation characterization and evaluation is done using the collected resistivity values which may be grouped into a side resistivity profile.

The drill bit analysis and optimization systems 600, 700 optimize the drill bits 601, 701 by either improving the cutter design or other drilling parameters or adjusting a drilling parameter in real-time based on the received data signals by the sensors 603, 604, 707, 708 which provide the resistivity and distance values of the system 600, 700. Specifically, FIG. 6 shows a measuring behind and ahead of the cutter 602 along the direction of bit rotation to analyze the cutter 602. In this example, the sensors 603, 604 are placed before and after the cutter 602 as described above in the direction of bit rotation 610. The receivers of the sensors 603, 604 placed in these locations are used to obtain the front and back resistivity 613, 615 and front and back formation resistivity 614, 616 between the sensors 603, 604 and the formation 605 that are used to calculate the front and back distances 611, 612 between each sensor 603, 604 and the formation 605. In a similar way, sensors 707, 708, as shown in FIG. 7, can be placed on both sides of the cutter 706 in the direction perpendicular to the direction of bit rotation. The sensors 707, 708 on the sides of the cutter 706 can also measure the side resistivity 713, 714, and the side formation resistivity 714, 716 of the formation 705, that are used to calculate distances 717, 718 between the formation 705 and the sensors 707, 708. The analysis of the collected data signals, resistivity values, and distances during the drilling process can give information about the condition of the cutter 602, 706 and other drilling properties that can be used to optimize drilling parameters.

Figure 8:
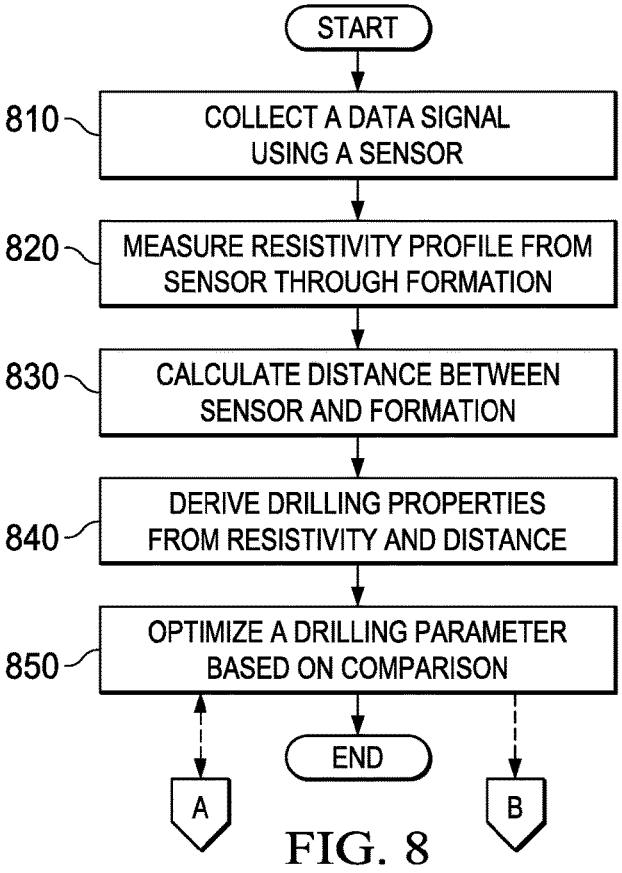
FIG. 8 is a flow diagram of a method for analyzing and optimizing a drill bit using a sensor according to one or more embodiments of the present disclosure.

FIG. 8 is a flow diagram of a method for analyzing and optimizing a drill bit using one or more sensors according to one or more embodiments of the present disclosure. The method includes collecting a data signal using one or more sensors disposed proximate to a cutter on the drill bit (operation 810). A processor and the collected data signal are then used to measure a resistivity profile that has values that extend from the one or more sensors through a formation (operation 820). The resistivity profile includes at least a resistivity value between the sensor and the formation (for example a mud resistivity) and a resistivity value within the formation (for example a formation resistivity). For example, looking at FIG. 6 a front resistivity profile would include both resistivity 613 and resistivity 614. In another embodiment the resistivity profile can include a plurality of resistivity values. The method then calculates, using the processor, a distance between the one or more sensors and the formation using the resistivity profile and an inversion scheme stored in a data reservoir (operation 830). Actual drilling properties of the wellbore are then derived from the resistivity profile and the distance using at least one of the inversion scheme and a drilling algorithm stored in a data reservoir (operation 840). The actual drilling properties include one or more of actual temperature, actual drill bit placement, actual revolutions per minute (RPM), actual fluid pressure, actual weight on bit (WOB), and a combination thereof. A drilling parameter is then optimized using the processor based on a comparison between the actual drilling properties calculated and expected drilling properties stored in the data reservoir (850). The expected drilling properties include one or more of expected temperature, expected drill bit placement, expected revolutions per minute (RPM), expected fluid pressure, expected weight on bit (WOB), and a combination thereof.

Figure 9A:
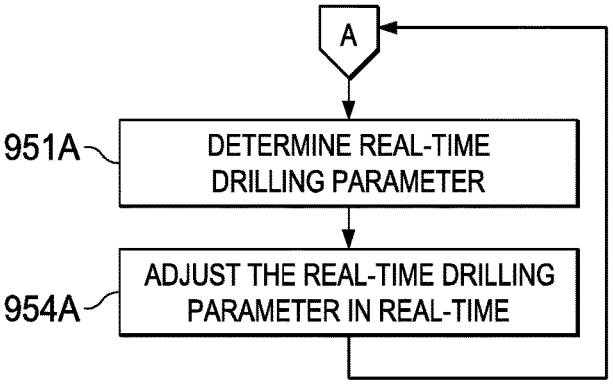
FIG. 9A is a flow diagram of a method for analyzing and optimizing a real-time drilling parameter according to one or more embodiments of the present disclosure.

In FIG. 9A illustrates an embodiment of a process for optimizing a real-time drilling parameter as illustrated in the operation 850. The real-time drilling parameter is one or more of weight on bit (WOB), revolutions per minute (RPM), mud injection rate, type of mud, drill speed, drill bit stoppage for replacement, temperature, drill bit placement, fluid pressure, pore pressure, or any other adjustment or variable that can be changed in real-time or near real-time during drilling operations. The method then further includes determining the real-time drilling parameter based on the comparison between the actual drilling properties and the expected drilling properties (operation 951A). Additionally, the method further includes adjusting the real-time drilling parameter in real-time (operation 954A).

Figure 9B:
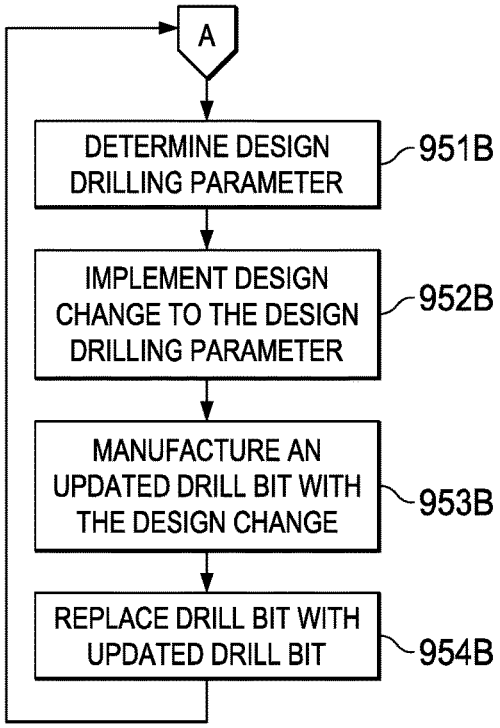
FIG. 9B is a flow diagram of a method for analyzing and optimizing a design drilling parameter according to one or more embodiments of the present disclosure.

In another embodiment, as shown in FIG. 9B, optimizing a drilling parameter may specifically be defined as optimizing a design drilling parameter, such as a drill bit design, a cutter design, a type of bit (fixed cutter, or roller cones); type of cutters used (e.g. geometry, orientation), weight on bit (WOB), drilling speed (RPM), rate of mud injection and type of mud. Specifically, the method may further include determining the design drilling parameter based on the comparison between the actual drilling properties and expected drilling properties (operation 951B). The method then implements a change to at least one design drilling parameter (operation 952B). The method then manufactures an updated drill bit that includes the design change (operation 953B). Finally, the method includes replacing the drill bit with the updated drill bit (operation 954B).

Figure 10:
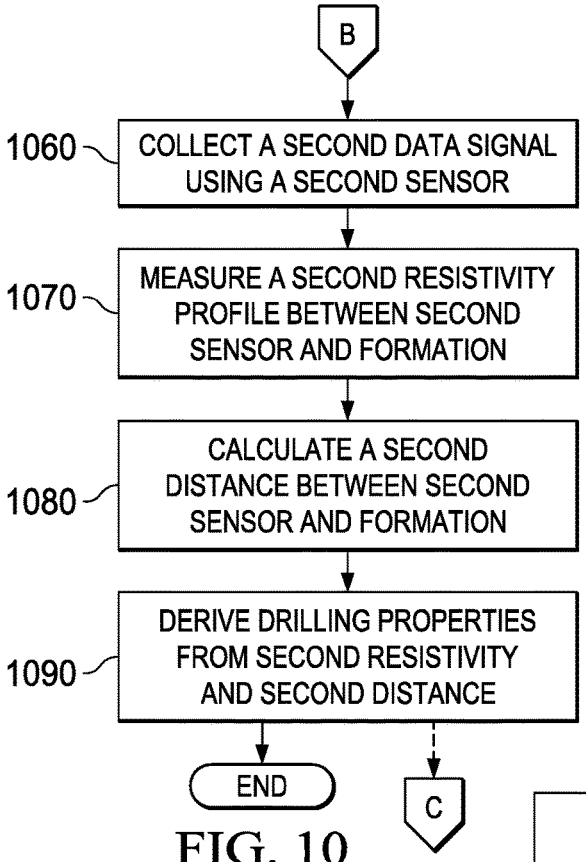
FIG. 10 is a flow diagram of a method for analyzing and optimizing a drill bit using a first and second sensor according to one or more embodiments of the present disclosure.

FIG. 10 illustrates another embodiment of a method for analyzing and optimizing the drill bit. The method includes all the operations as set out in FIG. 8 from the 'start' through 'B' as shown including operations 810 through 850. The method further includes the operations shown in FIG. 10. Particularly, the method includes collecting a second data signal using a second sensor disposed proximate to a cutter on the drill bit on side of the cutter opposite the sensor, wherein the cutter is disposed between the sensor and the second sensor (operation 1060). The method also includes measuring, using the processor and the collected second data signal, a second resistivity profile from the second sensor through a formation (operation 1070) and calculating, using the processor, a second distance between the second sensor and the formation using the second resistivity profile and the inversion scheme (operation 1080). Finally, the method includes deriving the actual drilling properties of the wellbore from the second resistivity profile and the second distance using at least one of the inversion scheme and the drilling algorithm stored in the data reservoir (operation 1090).

Figure 11:
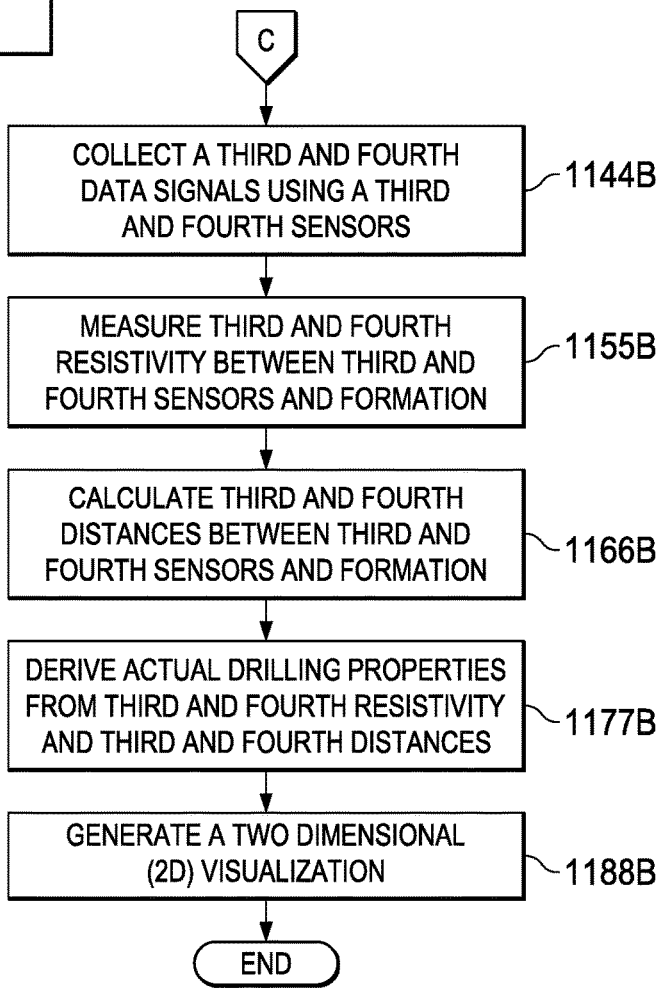
FIG. 11 is a flow diagram of a method for analyzing and optimizing a drill bit using a two-dimensional (2D) visualization scheme according to one or more embodiments of the present disclosure.

FIG. 11 illustrates another embodiment of a method for analyzing and optimizing the drill bit. The method of FIG. 11 includes all the operations as set out in FIG. 8 and also FIG. 10 starting from the 'start' in FIG. 8 and continuing through 'C' shown in FIG. 10. The method also uses a third and fourth sensor and generates a two-dimensional (2D) visualization. Specifically, the method may include collecting a third and fourth data signals using a third and fourth sensors disposed on the surface of the drill bit proximate to the cutter along a perpendicular axis that is perpendicular to the direction of bit rotation, wherein the cutter is disposed between the third and fourth sensors (operation 1144B). The method then measures, using the processor and the third and fourth data signals, a third and fourth resistivity profiles from the third and fourth sensors through the formation, respectively (operation 1155B). Further, the method calculates, using the processor, a third and fourth distances between the third and fourth sensors and the formation, respectively, using the inversion scheme, the third and fourth data signals, and the third and fourth resistivity profiles (operation 1166B). The method then derives, using the processor, the actual drilling properties from one or more of the third and fourth data signals, the third and fourth resistivity profiles, and the third and fourth distances in combination with one or more of the data signal, the second data signal, the resistivity profile, and the second resistivity profile, the distance, and the second distance using the drilling algorithm (operation 1177B). Finally, the method generates a two dimensional (2D) visualization using the data signal, the second data signal, and the third and fourth data signals from the first sensor, the second sensor, and the third and fourth sensors, respectively (1188B). The 2D visualization may represent a contour map of the formation showing a cut surrounding the cutter in the drill bit around where the first sensor, the second sensor, and the third and fourth sensors are located.

Figure 12:
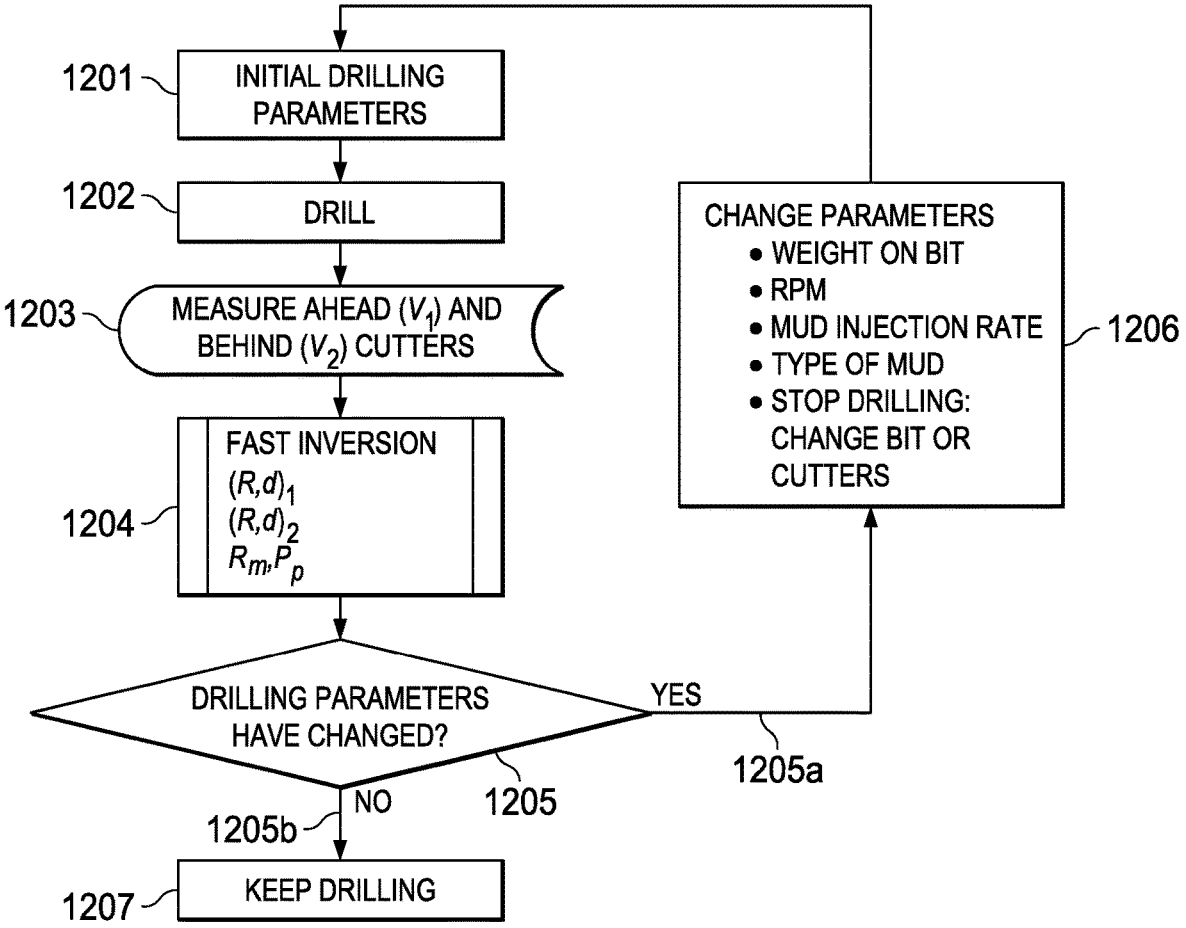
FIG. 12 is a flow diagram illustrating real-time optimization of a real-time drilling parameter according to one or more embodiments of the present disclosure.

According to another embodiment, FIG. 12 is a flow diagram illustrating real-time optimization of a real-time drilling parameter. Specifically, FIG. 12 shows an example of real-time optimization of a drilling process where an optimization scheme that can be executed while drilling. The optimization starts with initial drilling parameters (operation 1201). Drilling is then commenced using the initial parameters (operation 1202). During drilling with the initial parameters the sensors receive data signals, measure resistivity, and calculate distances (operation 1203). A drilling algorithm is then used such as, for example, a fast inversion scheme, to analyze an electromagnetic (EM) model produced for each receiver (operation 1204). The EM model includes resistivity and distance values that characterize the receiver. This analysis may be specifically accomplished by comparing the actual drilling properties versus the expected drilling properties.

Real-time optimization is then executed when the analysis of the drilling properties indicates that one or more of the real-time drilling parameters have changed (operations 1205 and 1205*a*) or needs to be changed. Then the real-time drilling parameters can be modified according to the analysis in real-time (operation 1206). For example, a decision to slow, speedup, or stop the drilling and change the bit or cutters may be made. In the event that no change to a drilling parameter is determined based on the analysis of the drilling properties (operations 1205 and 1205*b*) then drilling continues with the initial drilling parameters (operation 1207). In one embodiment, the real-time drilling parameters can be modified using an automated control system.

Figure 13:
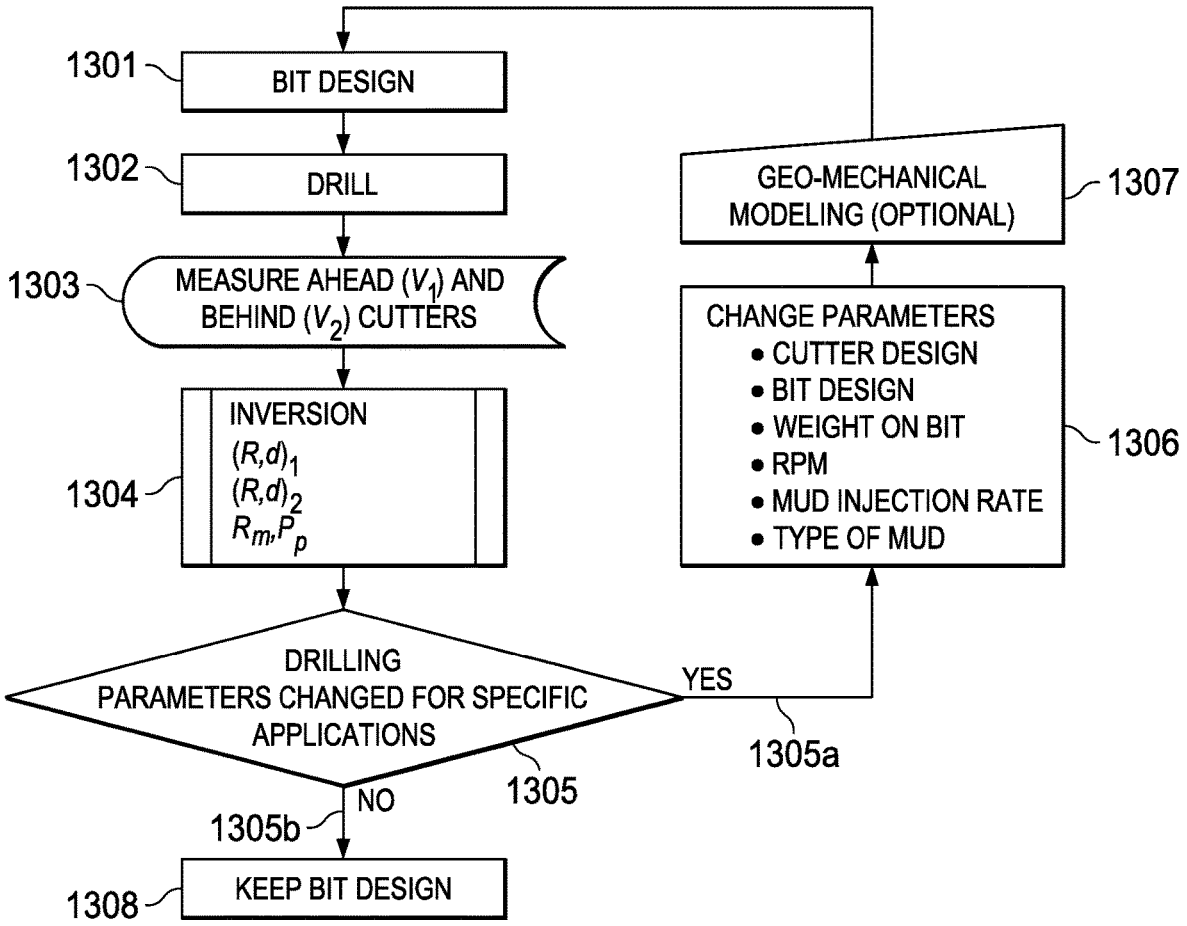
FIG. 13 is a flow diagram illustrating design optimization of a design drilling parameter according to one or more embodiments of the present disclosure.

FIG. 13 is a flow diagram illustrating a design optimization of a design drilling parameter according to an embodiment. Initially a drill bit with a certain bit design in provided (operation 1301). The drill bit is then operated using the initial drilling parameters (operation 1302). During drilling with the initial parameters the sensors receive data signals, measure resistivity, and calculate distances (operation 1303). A drilling algorithm is then used such as, for example, an inversion scheme, to analyze an EM model produced for each receiver (operation 1304). This analysis may be specifically accomplished by comparing actual drilling properties versus expected drilling properties.

Design optimization is then executed when the analysis of the drilling properties indicates that one or more of the drilling parameters have changed (operations 1305 and 1305*a*) or needs to be changed. Then the drilling parameters can be modified according to the analysis (operation 1306). Further, the design drilling parameters may be used to execute geo-mechanical modelling to develop the bit design (operation 1307). This geo-mechanical model uses the drilling parameters, resistivity, distances, and pore pressure obtained for each drilling application. Then, each time a parameter is changed, the bit design may be updated. Analyzing the previous drilling leads to optimizations of the bit design for future applications in similar geology. In the event that no change to a drilling parameter is determined based on the analysis of the drilling properties (operations 1305 and 1305*b*) then the bit design is maintained (operation 1308).

Figure 14:
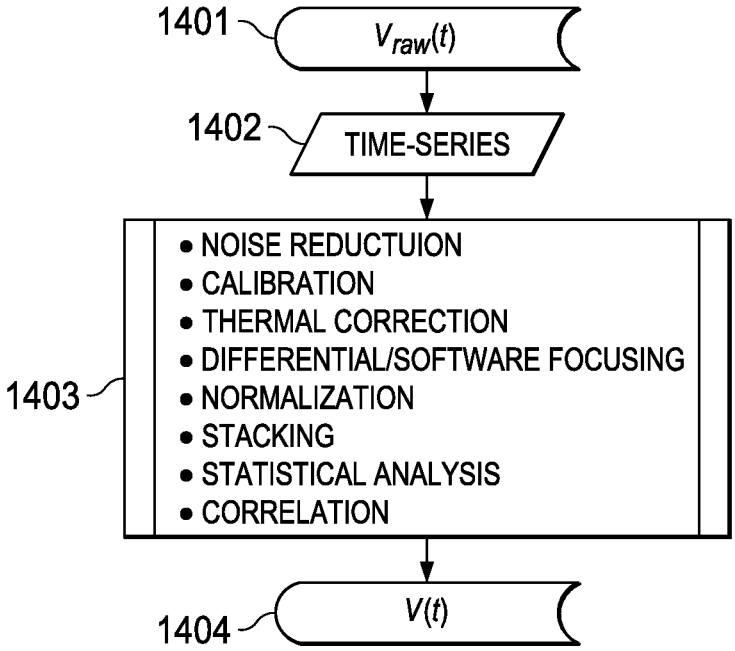
FIG. 14 is a flow diagram illustrating a processing scheme for collecting and processing data signals according to one or more embodiments of the present disclosure.

FIG. 14 shows a processing scheme for collecting data signals and preparing them to measure, calculate, and derive properties using the data signals according to an embodiment similar to operation 810 from FIG. 8. Reference will be made in the following descriptions for exemplary purposes only to compatible elements from FIGS. 6 and 7 that may provide the structure for implementing the following schemes and methods that are discussed. However, the processes and schemes discussed are not limited thereto. Accordingly, as shown in FIG. 14, deriving drilling properties begins by first collecting raw data in the Vraw(t) using at least one sensor 603, 604, 707, 708 (operation 1401). The collection of raw data, which can more clearly be referred to herewith as simply a data signal, can be collected in the time-domain for a defined time-series such that multiple data signals are collected over a certain time period covered by the defined time-series (operation 1402). Alternatively, the data signal can be collected in frequency-domain $\{A, \phi\}(f)$ defined by the amplitude A and phase $\phi$ of the signal for each frequency f. In yet another embodiment, the data signal can be collected in the time-domain and then processed into the frequency-domain using a transformation such as Fast Fourier Transform (FFT) or vice-versa.

Once the data signal is collected, derivation of drilling properties of the borehole proximate to the drill bit is done using one or more drilling algorithms to derive different drilling properties from the same data signal that is collected either over time or frequencies as described above (operation 1403). For example, processing in the form of a noise reduction technique (usually using filters) to remove noise on certain frequencies/times may be implemented to improve the collected data signal. The data signal can also be calibrated with known physical parameters (e.g. conductivity 6) from other logs stored in a data reservoir of the system. Thermal correction from known temperature tables stored in the data reservoir can be used to correct for temperature. Software focusing can be implemented or the differential of data signals from different sensor 603, 604, 707, 708 receivers can be determined and applied to remove or emphasize some cutters 602, 706. Data normalization can be applied to obtain a ratio between sensor 603, 604, 707, 708 receivers. Various receivers can be stacked together to obtain an average of measures from a sensor 603, 604, 707, 708. Statistical analysis of the data signal can be part of the processing. In addition, a statistical correlation between cutters can be calculated to obtain a better analysis of the cutter condition. Once processed, the data signal is provided V(t) in the same form as it was entered which, in this case, was in the time-domain (operation 1404).

Figure 15:
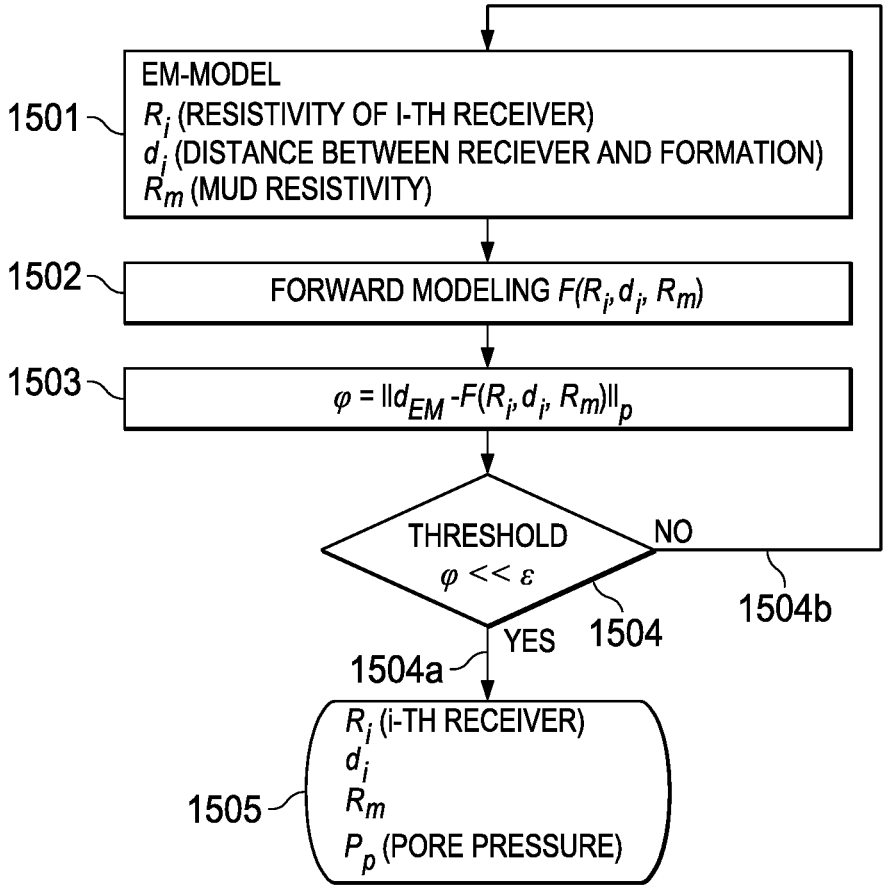
FIG. 15 is a flow diagram illustrating a deriving of drilling properties using drilling algorithms according to one or more embodiments of the present disclosure.

According to an embodiment, FIG. 15 is a flow diagram illustrating a specific example of deriving drilling properties using drilling algorithms similar to operation 840 of FIG. 8. Specifically, FIG. 15 shows using an inversion scheme algorithm along with other drilling algorithms to help determine pore pressure. In the inversion scheme, for each receiver an initial EM model consists of the resistivity of the formation of the receiver ($R_i$), the distance between the receiver and formation ($d_i$), and the resistivity of the mud ($R_m$) which may be received or previously calculated (operation 1501). Then a forward modelling technique is used to produce synthetic EM data $F(R_i, d_i, R_m)$ (operation 1502). The synthetic data is compared with the measured data by means of a norm (operation 1503). The functional $\varphi$ is minimized in an optimization scheme, by changing the input EM model and running this cycle until the functional reaches its minimum (operation 1504 and 1504*b*). When the minimum is reached (operation 1504*a*), the input EM model will be the resulting subsurface model (operation 1505). From the resistivity of EM model obtained, pore pressure of the formation can be calculated through another drilling algorithm, particularly, Eaton's equation. In this equation, the pore pressure $P_p$ is obtained by the ratio of the measured resistivity with the resistivity of the formation in a normal compaction condition. The drilling properties of formation (e.g. resistivity, distance between receiver and formation, pore pressure) can be used to analyze drilling performance in real-time.

The above inversion scheme has been described for a single sensor receiver position. However, various sensor receivers 603, 604, 707, 708 positions can be used to study different dimensions of the cut by a single cutter 602, 706. If the sensors 603, 604, 707, 708 are placed in both positions, combining FIGS. 6 and 7, then a 2D analysis of the cut can be obtained. Also a 2D map of the cut on top of a 3D formation may be generated. For example, the 2D view of the cut may be a contour map showing the cut surrounding a single cutter 602 on a drill bit 601.

According to other embodiments, sensors are located on the drill bit, close to each cutter, to measure the standoff resistivity of the formation being drilled. The distance between the sensor and the formation can be calculated in the inversion of the measured data. These sensors are either electrodes or magnetic coils. Depending on the drilling application, the selection of electrode or coils is made, or both sensors can be placed in the drill bit. Bit design optimization comprises a cycle in which the drilling is analyzed with respect to the geology and geophysical characteristics of the drilling area. This analysis can be used for design optimization, in which the drilling design is optimized by previous real-time applications and used for future applications in similar geology. In addition, the optimization can be executed on real time, to improve drilling parameters on the process of drilling.

According to an embodiment, the use of a cluster of electromagnetic sensors to analyze each cutter in a drill bit by measuring the distance between sensors provides a better image on the performance of a bit design. The analysis of a cutter can be obtained by a cluster of sensors around the cutter. The difference or gradient between sensors provide information about the condition of the cutter. The application of these electromagnetic sensors can produce 2D images of the cut and can be used to optimize the cutter designs, and overall drilling designs on real-time drillings or for future drilling applications.

A feature provided by one or more embodiments discussed above includes analysis of cutter condition and drilling condition by measuring the standoff resistivity and distance between a sensor placed on the vicinity of a cutter and the formation. Other features of one or more embodiments include, but are not limited to: the use of a cluster of sensors between each cutter in a direction orthogonal to rotation and along rotation to obtain a 2D image of the formation being cut and the cutter condition; the use of a cluster of sensors to obtain differential or gradient between sensors to emphasize some cutters; the use of any proximity sensors, such as electromagnetic sensors or acoustic sensors to obtain the distance between the sensor and formation from the physical properties of the formation; and the use of an automated control system to change drilling parameters automatically.

It should be apparent from the foregoing that embodiments of an invention having significant advantages have been provided. While the embodiments are shown in only a few forms, the embodiments are not limited but are susceptible to various changes and modifications without departing from the spirit thereof.

For example, in an alternative embodiment, a drill bit analysis and optimization system for use in a wellbore includes a drill bit including a plurality of cutters on a surface of the drill bit, a sensor disposed on the surface of the drill bit proximate to a cutter from the plurality of cutters, wherein the sensor is operable to collect a data signal, a data reservoir that is operable to store expected drilling properties and drilling algorithms, and a processor that receives the data signal from the sensor and receives the expected drilling properties from the data reservoir. The processor is operable to analyze the data signal to detect a resistivity profile from the sensor through the formation, calculate a distance between the sensor and the formation using an inversion scheme from the drilling algorithms, the data signal, and the resistivity profile, derive actual drilling properties of the wellbore proximate to the drill bit from one or more of the data signal, the resistivity profile, and the distance using the drilling algorithms, and determine an optimization to a drilling parameter by comparing the actual drilling properties with the expected drilling properties.

In another embodiment, the sensor is a first sensor, and the drill bit analysis and optimization system further includes a second sensor disposed on the surface of the drill bit proximate to the cutter on an opposite side of the cutter from the first sensor, wherein the cutter is disposed between the first sensor and second sensor, and wherein the second sensor is operable to collect a second data signal. The processor is further operable to analyze the second data signal to detect a second resistivity profile from the second sensor through the formation, calculate a second distance between the second sensor and formation using the inversion scheme, the second data signal, and the second resistivity profile, and derive the actual drilling properties from one or more of the second data signal, the second resistivity profile, and the second distance in combination with one or more of the data signal, the resistivity profile, and the distance using the drilling algorithms.

In another embodiment, the first sensor is located ahead of the cutter in a direction of bit rotation, wherein the distance calculated is a front distance ahead of the cutter, and the second sensor is located behind the cutter in the direction of bit rotation, wherein the second distance calculated is a rear distance behind the cutter.

In another embodiment, the drill bit analysis and optimization system, further including a third and fourth sensors disposed on the surface of the drill bit proximate to the cutter along a perpendicular axis that is perpendicular to the direction of bit rotation, wherein the cutter is disposed between the third and fourth sensors, wherein the third and fourth sensors are operable to collect a third and fourth data signals. The processor is further operable to analyze the third and fourth data signals to detect a third and fourth resistivity profiles between the third and fourth sensors and the formation, respectively, calculate a third and fourth distances between the third and fourth sensors and the formation, respectively, using the inversion scheme, the third and fourth data signals, and the third and fourth resistivity profiles, and derive the actual drilling properties from one or more of the third and fourth data signals, the third and fourth resistivity profile, and the third and fourth distances in combination with one or more of the data signal, the second data signal, the resistivity profile, and the second resistivity profile, the distance, and the second distance using the drilling algorithms.

In another embodiment, the processor is further operable to generate a two dimensional (2D) visualization using the data signal, the second data signal, and the third and fourth data signals from the first sensor, the second sensor, and the third and fourth sensors, respectively, wherein the 2D visualization represented a contour map of the formation showing a cut surrounding the cutter on the drill bit around where the first sensor, the second sensor, and the third and fourth sensors are located.

In another embodiment, the processor is further operable to select the design drilling parameter from a group consisting of drill bit design, cutter design, and a combination thereof, and wherein the optimization to the design drilling parameter includes implementing a design change to one or more of the drill bit design and the cutter design, wherein the design change is included in an updated drill bit that is manufactured, and wherein the drill bit is replaced with the update drill bit.

In another embodiment, the processor is further operable to select the real-time drilling parameter from a group consisting of weight on bit, revolutions per minute, mud injection rate, mud type, and a combination thereof, and wherein the optimization to the real-time drilling parameter includes adjusting the real-time drilling parameter in real-time.

In another embodiment, the resistivity profile includes at least a mud resistivity value and a formation resistivity value, and the second resistivity profile includes at least a second mud resistivity value and a second formation resistivity value.

In another embodiment, the sensor is at least one from a group consisting of an electrode, a magnetic coil, and a combination thereof.

Further, in an alternative embodiment, the a drill bit cutter sensor system for use in a wellbore includes a first sensor disposed on a surface of a drill bit proximate and in front of a cutting edge of a cutter, wherein the first sensor receives a first data signal, and a second sensor disposed on the surface of the drill bit proximate and behind the cutter, wherein the second sensor receives a second data signal, a data reservoir containing expected drilling properties and drilling algorithms, and a processor. The processor operable to measure a first resistivity profile and a second resistivity profile using the first data signal and the second data signal, respectively, determine a first distance between the first sensor and the formation and a second distance between the second sensor and the formation using an inversion scheme, derive actual drilling properties using one or more of the first resistivity profile, the second resistivity profile, the first data signal, the second data signal, the first distance, and the second distance, and determine an optimization to a drilling parameter by comparing the actual drilling properties and the expected drilling properties.

In another embodiment, the processor is provided at a location selected from a group consisting of within the first sensor, within the second sensor, within the drill bit, uphole in a logging while drilling (LWD) device in a drill string that the drill bit is attached to, at a surface of the wellbore, and a combination thereof.

In another embodiment, the drill bit cutter sensor system further includes a third sensor disposed on the surface of the drill bit proximate to the cutter along a perpendicular axis that is perpendicular to the direction of bit rotation, and a fourth sensor disposed on the surface of the drill bit proximate to the cutter along the perpendicular axis on a side of the cutter opposite the third sensor, wherein the cutter is disposed between the third sensor and the fourth sensor.

In another embodiment, the drill bit cutter sensor system further includes a transmitter that is operable to source the data signal by transmitting the data signal toward the formation.

Further in an alternative embodiment, a method of drill bit analysis and optimization using a sensor in a drill bit in a wellbore is provided. The method includes collecting a data signal using the sensor disposed proximate to a cutter on the drill bit, measuring, using a processor and the collected data signal, a resistivity profile from the sensor through a formation, calculating, using the processor, a distance between the sensor and the formation using the resistivity profile and an inversion scheme, deriving actual drilling properties of the wellbore from the resistivity profile and the distance using at least one of the inversion scheme and a drilling algorithm stored in a data reservoir, and optimizing, using the processor, a drilling parameter based on a comparison between the actual drilling properties calculated and expected drilling properties stored in the data reservoir.

In another embodiment, the drilling parameter is a real-time drilling parameter, and optimizing the real-time drilling parameter further includes determining the real-time drilling parameter based on the comparison between the actual drilling properties and expected drilling properties, wherein the real-time drilling parameter is one or more of temperature, drill bit placement, revolutions per minute (RPM), fluid pressure, pore pressure, and weight on bit (WOB), and adjusting the real-time drilling parameter in real-time.

In another embodiment, the drilling parameter is a design drilling parameter, and optimizing the design drilling parameter further includes determining the design drilling parameter based on the comparison between the actual drilling properties and expected drilling properties, wherein the design drilling parameter is one or more of a drill bit design and a cutter design, implementing a design change to at least one of the drill bit design and the cutter design, manufacturing an updated drill bit that includes the design change, and replacing the drill bit with the update drill bit.

In another embodiment, the method further includes collecting a second data signal using a second sensor disposed proximate to a cutter on the drill bit on side of the cutter opposite the sensor, wherein the cutter is disposed between the sensor and the second sensor, measuring, using the processor and the collected second data signal, a second resistivity profile from the second sensor through the formation, calculating, using the processor, a second distance between the second sensor and the formation using the second resistivity profile and the inversion scheme, and deriving the actual drilling properties of the wellbore from the second resistivity profile and the second distance using at least one of the inversion scheme and the drilling algorithm stored in the data reservoir.

In another embodiment, the resistivity profile includes a plurality of resistivity values from near the sensor and extending through the formation, and the second resistivity profile includes a second plurality of resistivity values from near the second sensor and extending through the formation.

In another embodiment, the method, further includes collecting a third and fourth data signals using a third and fourth sensors disposed on the surface of the drill bit proximate to the cutter along a perpendicular axis that is perpendicular to the direction of bit rotation, wherein the cutter is disposed between the third and fourth sensors, measuring, using the processor and the third and fourth data signals, a third and fourth resistivity profiles from the third and fourth sensors through the formation, respectively, calculating, using the processor, a third and fourth distances between the third and fourth sensors and the formation, respectively, using the inversion scheme, the third and fourth data signals, and the third and fourth resistivity profiles, deriving, using the processor, the actual drilling properties from one or more of the third and fourth data signals, the third and fourth resistivity profiles, and the third and fourth distances in combination with one or more of the data signal, the second data signal, the resistivity profile, and the second resistivity profile, the distance, and the second distance using the drilling algorithm, and generating a two dimensional (2D) visualization using the data signal, the second data signal, and the third and fourth data signals from the first sensor, the second sensor, and the third and fourth sensors, respectively, wherein the 2D visualization represented a contour map of the formation showing a cut surrounding the cutter in the drill bit around where the first sensor, the second sensor, and the third and fourth sensors are located.

While exemplary embodiments have been described with respect to a limited number of embodiments, those skilled in the art, having the benefit of this disclosure, will appreciate that other embodiments can be devised which do not depart from the scope as disclosed herein. Accordingly, the scope should be limited only by the attached claims.

We claim:

1. A drill bit analysis system for use in a wellbore comprising:

a drill bit having a plurality of cutters on an exterior surface thereof;

a sensor disposed on the surface of the drill bit proximate to a cutter from the plurality of cutters, wherein the sensor generates a data signal; and a signal processor unit that:

receives the data signal from the sensor;

analyzes the data signal to derive actual drilling properties of a subterranean earthen formation that is encountered by the cutter;

calculates a distance between the sensor and the subterranean earthen formation from at least one of the data signal, a resistivity profile, and a stored drilling algorithm;

compares the actual drilling properties with expected drilling properties;

determines at least one of an adjustment to a drilling parameter and a change in an operation of the drill bit based on a comparison of the actual drilling properties with the expected drilling properties; and performs at least one of the adjustment to the drilling parameter and the change in the operation of the drill bit.

2. The system of claim 1, wherein the signal processor unit derives the actual drilling properties of the subterranean earthen formation from one or more of the data signal, the resistivity profile, and the distance.

3. The system of claim 1, further comprising:

a second sensor disposed on the exterior surface of the drill bit on an opposite side of the cutter, wherein the signal processor unit further derives the actual drilling properties of the subterranean earthen formation from a second signal generated by the second sensor.

4. The system of claim 3, wherein the sensor is located ahead of the cutter in a direction of bit rotation and the second sensor is located behind the cutter in a direction of bit rotation, and wherein the signal processor unit uses differences between the data signal and the second signal to determine the adjustment to the drilling parameter.

5. The system of claim 4, and further comprising a third sensor and a fourth sensor, wherein the third and fourth sensors are disposed on the exterior surface of the drill bit proximate to the cutter along an axis that is perpendicular to the direction of bit rotation, and wherein the signal processor unit generates a contour map of the subterranean earthen formation showing a cut surrounding the cutter.

6. The system of claim 1, wherein wherein the signal processor unit adjusts the drilling parameter of the drill bit during drilling operations.

7. The system of claim 1, wherein a drilling property of the drilling properties is a condition of the cutter, and wherein the signal processor unit determines when such cutter should be replaced in response to determining the condition.

8. The system of claim 1, wherein a drilling property of the drilling properties is a condition of the subterranean earthen formation, and wherein the signal processor unit performs the adjustment to the operation of the drill bit in response to a change in the condition of the subterranean earthen formation.

9. A drill bit cutter sensor system for use in a wellbore comprising:

a first sensor disposed on a surface of a drill bit proximate and in front of a cutting edge of a cutter, wherein the first sensor receives a first data signal;

a second sensor disposed on the surface of the drill bit proximate and behind the cutter, wherein the second sensor receives a second data signal; and a signal processor unit operable to:

measure a first resistivity profile and a second resistivity profile using the first data signal and the second data signal, respectively, determine a first distance between the first sensor and a subterranean earthen formation and a second distance between the second sensor and the subterranean earthen formation using an inversion scheme, derive actual drilling properties using the first resistivity profile, the second resistivity profile, the first distance, and the second distance, compare the actual drilling properties and expected drilling properties; and change an operating parameter of the drill bit during drilling operations based on a comparison of the actual drilling properties with the expected drilling properties.

10. The system of claim 9, wherein the signal processor unit recommends a repair or replacement of the cutter.

11. A method of drill bit analysis using a sensor in a drill bit in a wellbore, the method comprising:

collecting a data signal using the sensor disposed proximate to a cutter on the drill bit;

measuring, using a processor and the collected data signal, a resistivity profile from the sensor through a formation;

calculating, using the processor, a distance between the sensor and the formation;

deriving actual drilling properties of the wellbore from the resistivity profile and the distance;

comparing between the actual drilling properties and expected drilling properties;

determining a drilling parameter based on the comparison between the actual drilling properties and the expected drilling properties; and performing an adjustment of the drilling parameter.

12. The method of claim 11, wherein the drilling parameter is a real-time drilling parameter, wherein determining the drilling parameter further comprises determining the real-time drilling parameter based on the comparison between the actual drilling properties and expected drilling properties; and wherein performing an adjustment of the drilling parameter comprises performing the adjustment of the drilling parameter in real-time.

13. The method of claim 11, further comprising:

collecting a second data signal using a second sensor disposed proximate to a second cutter on the drill bit on side of the cutter opposite the sensor, wherein the second cutter is disposed between the sensor and the second sensor;

measuring, using the processor and the collected second data signal, a second resistivity profile from the second sensor through the formation;

calculating, using the processor, a second distance between the second sensor and the formation using the second resistivity profile; and deriving the actual drilling properties of the wellbore from the second resistivity profile and the second distance.

14. The method of claim 13, wherein the resistivity profile comprises a plurality of resistivity values from near the sensor and extending through the formation, and wherein the second resistivity profile comprises a second plurality of resistivity values from near the second sensor and extending through the formation.

15. The method of claim 13, further comprising:

collecting a third and fourth data signals using a third and fourth sensors disposed on the surface of the drill bit proximate to the cutter along a perpendicular axis that is perpendicular to the direction of bit rotation, wherein the cutter is disposed between the third and fourth sensors;

measuring, using the processor and the third and fourth data signals, a third and fourth resistivity profiles from the third and fourth sensors through the formation, respectively;

calculating, using the processor, a third and fourth distances between the third and fourth sensors and the formation, respectively, using an inversion scheme, the third and fourth data signals, and the third and fourth resistivity profiles; and generating a two dimensional (2D) visualization using the data signal, the second data signal, and the third and fourth data signals, wherein the 2D visualization represents a contour map of the formation showing a cut surrounding the cutter in the drill bit around where the sensor, the second sensor, and the third and fourth sensors are located.

* * * * *